US008347574B2

(12) United States Patent
Michiels

(10) Patent No.: US 8,347,574 B2
(45) Date of Patent: Jan. 8, 2013

(54) JOINT ELEMENTS FOR SLABS

(75) Inventor: Pierre Michiels, Tervuren (BE)

(73) Assignee: Plakabeton S.A., Ternat (BE)

( * ) Notice: Subject to any disclaimer, the term of this patent is extended or adjusted under 35 U.S.C. 154(b) by 0 days.

(21) Appl. No.: 12/909,282

(22) Filed: Oct. 21, 2010

(65) Prior Publication Data

US 2011/0088347 A1 Apr. 21, 2011

(30) Foreign Application Priority Data

Oct. 21, 2009 (EP) ..... 09447051

(51) Int. Cl.
*E04B 1/682* (2006.01)

(52) U.S. Cl. ..... 52/396.02; 52/396.07; 404/58

(58) Field of Classification Search ..... 52/56–58, 52/396.02, 396.04, 396.05, 396.07; 404/56–58
See application file for complete search history.

(56) References Cited

U.S. PATENT DOCUMENTS

| | | | | |
|---|---|---|---|---|
| 2,337,156 | A * | 12/1943 | Elmendorf | 52/391 |
| 4,127,352 | A | 11/1978 | Peters | |
| 5,897,816 | A * | 4/1999 | Johnson | 264/35 |
| 6,354,760 | B1 * | 3/2002 | Boxall et al. | 404/56 |
| 8,091,306 | B2 * | 1/2012 | Kerrels | 52/396.05 |

FOREIGN PATENT DOCUMENTS

| | | |
|---|---|---|
| CH | 594 106 | 12/1977 |
| EP | 1 034 340 B1 | 9/2000 |
| EP | 1 389 648 A1 | 2/2004 |
| EP | 1 584 746 A2 | 10/2005 |
| EP | 1 584 746 A3 | 10/2005 |
| EP | 1 867 783 A2 | 12/2007 |
| EP | 1 985 759 A1 | 10/2008 |
| WO | 99/31329 | 6/1999 |
| WO | 2008/064436 A1 | 6/2008 |

OTHER PUBLICATIONS

European Search Report issued Mar. 24, 2010 in priority Application No. EP 09 44 7051.5.

* cited by examiner

*Primary Examiner* — Jeanette E Chapman
*Assistant Examiner* — Daniel Kenny
(74) *Attorney, Agent, or Firm* — Hovey Williams LLP

(57) ABSTRACT

A system for transferring loads across a joint between cast-in-place slabs, more particularly at crossover point of a joint between cast-in-place slabs, includes at least one dowel plate and joint elements and includes elements or abutments for limiting the relative movements of the dowel plate towards the joint elements along three orthogonal directions.

43 Claims, 15 Drawing Sheets

JOINT ELEMENTS FOR SLABS

This application claims the benefit of EP 09 447 051.5 filed Oct. 21, 2009, the entire disclosure of which is incorporated herein by reference.

BACKGROUND OF THE INVENTION

1. Field of the Invention

The present invention relates to a system for transferring loads across a joint between cast-in-place slabs, more particularly at a crossover point of a joint between cast-in-place slabs. The system for transferring loads at a crossover point comprises at least one dowel plate and means for limiting the relative movements of the dowel plate towards the joint elements along three orthogonal directions.

2. The Prior Art

Systems for transferring loads across a joint between cast-in-place slabs are disclosed for example in EP1034340, EP1584746, EP1985759, EP1867783, WO2008/064436. Each slab is provided along its edges with a metal profile working with the profile extending along an edge of an adjacent slab. At the corner of the slab defined between a first edge with a first metal profile and a second edge with a second metal profile, the said first and second profiles are welded together, so as to increase the protection of the corner. (see for example FIG. 7 of EP1389648).

However, at the crossover point of the four cast-in-place slabs, there is no means for transferring load between two cast-in-place slabs, especially a means for transferring load between two cast-in-place slabs having no direct joint there between formed by metal profiles located in front the one to the other.

When vehicles are passing over one crossover point, a good load transfer is not achieved at the crossover points, meaning that formation of cracks at the corners of the slabs adjacent to the crossover point will appear, such cracks then forming the start of larger damages within the slabs.

The correct welding together of the two ends of metal profiles is not easy as a correct angle has to be respected, as the profiles has to be cut at the correct length for having the ends to be welded together adjacent the one to the other, and as the free place for the welding operation is limited.

In order to prevent the welding together of ends of profiles intended to form a corner of a cast-in-place slab, it has been proposed to form crossover point system comprising four angle joint elements, whereby each of said angle joint element comprises a portion of a first profile, a portion of a second profile, and a welding line connecting an end of the portion of the first profile to an end of the profile of the second profile. Said profile portions welded together define a right angle there between.

The said portions of the profiles welded together are each provided with a U shaped part defining a channel. The channel of a portion of a profile of one angle joint element extends in front of a channel of a portion of a profile of another angle joint element.

Each portion of the profiles of each joint angle is then welded with a profile adapted to extend along an edge of a cast-in-place slab, whereby along each edge of a slab, an elongated channel is formed extending from, one corner from a slab to another corner of the considered slab. The welding operation is complicated as requiring the welding the U shaped part of a portion of an angle joint element with the U shaped part of the adjacent profile.

After the welding is operated, a band is placed in the longitudinal passage formed by the channels of profiles located in front the one to the other. In said passage, longitudinal metal bands (having a constant width all along their length) are placed so as to form means for transferring load between the profiles located between the edges of two adjacent cast-in-place slabs, i.e. from one profile to the other profile.

The bands have a length adapted for not crossing the crossover point between angle join elements.

This system is used for transferring a load from one profile attached to one cast in-place slab to another profile attached to another cast-in-place slab, but not for transferring a load across the adjacent corners of the four adjacent slabs.

Furthermore, it has been observed that cast-in-place slabs provided with angle joint elements formed by profile portions welded together at right angles had some cracks due to retraction phenomena of the concrete cast within the slab spaces defined between the various joint profiles.

The present invention seeks to provide a simple system enabling an easy load transfer at the corners of three or four adjacent slabs, enabling an effective load transfer across the crossover point. Moreover, in preferred embodiments of the invention, the system of the invention enables a better resistance to the appearance of cracks at the corner ends of the cast-in-place slabs.

Another goal of the system of the invention is to provide a system for efficiently transferring loads at a crossover point of a joint between cast-in-place slabs.

SUMMARY OF THE INVENTION

The system of the invention is a system for transferring loads at a crossover point (CO) of a joint between at least a first, a second and a third cast-in-place slabs, said system comprising at least one dowel plate (50) and at least a first angle joint profile or element (10) attached to the first cast-in-place slab, a second angle joint profile or element (20) attached to the second cast-in-place slab, a third joint profile or element (30) attached to the third cast-in-place slab, whereby at one relative movement between at least two of said joint profiles or elements occurs during the hardening of the cast-in-place slabs, whereby the said first, second and third joint profiles or elements (10,20,30) and the dowel plate are adapted so that, after hardening of the cast-in-lace slabs and the said relative movement between at least two of said joint profiles or elements, the dowel plate (50) has at least a first portion extending within the first cast-in-place slab after its hardening or a casing attached to the first cast-in place slab after its hardening, a second portion extending within the second cast-in-place slab after its hardening or a casing attached to the second cast-in place slab after its hardening, and a third portion extending within the third cast-in-place slab after its hardening or a casing attached to the third cast-in place slab after its hardening, and whereby at least two joint profiles or elements (10,20) or casings attached to said at least two joint profiles or elements, preferably at least said three joint profiles or elements are provided with means, advantageously one or more abutments, for limiting the relative movements of the dowel plate (50) towards the said at least two joint profiles or elements, preferably said three joint profiles or elements along three orthogonal directions.

The means for limiting the relative movements of the dowel plate, advantageously the abutment(s), act(s) as means for ensuring that the dowel plate or load transfer plate is always located at the crossover point, and cannot be taken away from the crossover point before casting in place the slabs. This is important for ensuring the placement of the dowel plate at the right place, i.e. at the crossover point before the casting of the slabs, and thus also after the hardening of said cast-in-place slabs.

The dowel plate is preferably mounted to be mobile with respect to at least two joint profiles or elements, preferably with respect to all joint profile or elements defining the crossover point. However in some embodiments, the dowel plate (50) can be attached to or even be a part of one joint profile or element (for example the third joint profile or element for a crossover point between three cast-in-place slabs). The dowel plate can be, for example, welded to one joint profile or element, advantageously to one corner joint profile or element.

According to an advantageous embodiment, the system is adapted for transferring loads at a crossover point (CO) of a joint between at least a first, a second, a third and a fourth cast-in-place slabs, said system further comprising a fourth joint profile or element (40) attached to the fourth cast-in-place slab, whereby at one relative movement between at least three joint profiles or elements occurs during the hardening of the cast-in-place slabs, whereby the joint profiles or elements (10,20,30,40) are each an angle joint profile or element, whereby the angle joint profiles (10,20,30,40) and the dowel plate are adapted so that, after hardening of the cast-in-lace slabs and the said relative movement between at least three joint profiles or elements, the dowel plate (50) has at least a first portion extending within the first cast-in-place slab after its hardening or a casing attached to the first cast-in place slab after its hardening, a second portion extending within the second cast-in-place slab after its hardening or a casing attached to the second cast-in place slab after its hardening, a third portion extending within the third cast-in-place slab after its hardening or a casing attached to the third cast-in place slab after its hardening, and a fourth portion extending within the fourth cast-in-place slab after its hardening or a casing attached to the fourth cast-in place slab after its hardening, and whereby said first, second third and fourth joint profiles or elements (10,20,30,40) or casings attached to said joint profiles or elements are provided with abutments limiting the relative movements of the dowel plate (50) towards the said four joint profiles or elements along three orthogonal directions.

According to a detail of a preferred embodiment, the system comprises at least:

a first angle joint element (10) located at a corner of the first cast-in-place slab, said first angle joint element (10) comprising at least a first face portion (11) and a second face portion (12) connected the one to the other, and at least one anchor (14,15) serving as an anchor means extending within the first cast-in-place slab (1), a second angle joint element (20) located at a corner of the second cast-in-place slab (2), said second angle joint element (20) comprising at least a first face portion (21) and a second face portion (22) connected the one to the other, and at least one anchor (24, 25) serving as an anchor means extending within the second cast-in-place slab (2), whereby the second face portion (22) of the second angle joint element (20) extends substantially in front of the first face portion (11) of the first angle joint element (10), a third joint element (30) located along an edge or a corner of the third cast-in-place slab (3), said third joint element (30) comprising at least a face portion (31,32) and at least one anchor (34, 35) serving as an anchor means extending within the third cast-in-place slab (3), whereby said face portion of the third joint element extends in front of a face portion (11,12) of the first angle joint element (10) and/or a face portion (21, 22) of the second angle joint element (20), optionally, but preferably, a fourth joint element (40) located along an edge and/or a corner of the fourth cast-in-place slab (4), said fourth joint element comprising at least a face portion (41,42) and at least one anchor (44,45) serving as an anchor means extending within a fourth cast-in-place slab (4), whereby said face portion of the optional fourth joint element extends in front of a face portion of the first angle joint element (10) or a face portion of the second angle joint element (20) or a face portion of the third joint element (30), and at least one plate (50) for transferring load at least between the cast-in-place slabs (1,2,3,4) in the neighbourhood of or proximate the first and second angle joint elements, especially at least at the bent or curved or angled ends of said first and second angle joint elements.

Preferably in said embodiment, at least the first angle joint element (10) and the second angle joint element (20) each comprise a profile which is bent or curved so as to form the first face portion (11,21), the second face portion (12,22), and a bending or curved portion (13,23) extending between the first and second face portions (11,21;12,22) and connecting said first and second face portions together, whereby said bending or curved portion (13,23) has a curvature with a radius (R) of at least 3 mm, advantageously comprised between 4 mm and 40 mm.

The first angle joint element (10) and the second angle joint element (20) are each provided with an opening (16,26) extending in the bending or curved portion (13,23) and partly in the first and second face portions (11,12;21,22), while the third joint element (30) is provided with an opening (36), or while the third and fourth joint elements (30,40) are provided each with an opening (36,46), whereby the openings (16,26) of the first and second angle joint elements (10,20) and the opening (36) of the third joint element (30) or the openings (16,26) of the first and second angle joint elements (10,20) and the openings (36,46) of the third and fourth joint elements (30,40) extend substantially in a same plane (P1).

The means for transferring load between the cast-in-place slabs is a plate element (50) extending through the said openings (16,26,36 or 16,26,36,46) of the first and second angle joint elements, and of the third joint element or the third and fourth joint elements.

According to a detail of another advantageous embodiment with a third and fourth angle joint elements (30,40), the third angle joint element (30) is located at a corner of the third cast-in-place slab, said third angle joint element comprising at least a first face portion (31) and a second face portion (32) connected the one to the other, and at least one anchor (34,35) serving as an anchor means extending within the third cast-in-place slab (3), while the fourth angle joint element (40) is located at a corner of the fourth cast-in-place slab (4), said fourth angle joint element (40) comprising at least a first face portion (41) and a second face portion (42) connected the one to the other, and at least one anchor (44,45) serving as an anchor means extending within the fourth cast-in-place slab (4), whereby the first face portion of the fourth angle joint element extends substantially in front of the first or second face portion of the third angle joint element.

Preferably, the third angle joint element (30) and the fourth angle joint element (40) comprise each a profile which is bent or curved so as to form the first face portion (31,41), the second face portion (32,42), and a bending or curved portion (33,43) extending between the first and second face portions and connecting said first and second face portions together, whereby said bending or curved portion (33,43) has a curvature with a radius (R) of at least 3 mm, advantageously comprised between 4 mm and 40 mm. The third angle joint element (30) and the fourth angle joint element (40) are each provided with an opening (36,46) extending in the bending or curved portion (33,43) and partly in the first and second face portions (31,41;32,42), whereby the openings (16,26,36,46) of the first, second, third and fourth angle joint elements extend substantially in a same plane (P1).

The means for transferring load between the cast-in-place slabs is a plate element (50) extending through the said openings (16,26,36,46) of the first, second, third and fourth angle joint elements.

According to details of one or more embodiments of system of the invention,

- at least one rod extends between the first face portion and the second face portion of the first and/or second and/or third and/or fourth angle joint elements, and/or
- the plate has a square, rectangular, circular or oval shape, or portions thereof or a combination of such shapes, advantageously with edges of at least 10 cm, preferably with rounded ends, while the thickness thereof is advantageously comprised between 3 mm and 20 mm, advantageously between 4 mm and 15 mm, such as comprised between 8 mm and 15 mm, such as 8 mm, 10 mm, 12 mm, 14 mm, and/or
- the first and/or second and/or third and/or fourth angle joint elements are provided with means for connecting the considered angle joint element to one or more joint profiles intended for acting along adjacent lateral edges of adjacent slabs, and/or
- the first and/or second and/or third and/or fourth angle joint elements are provided with one or more dowels, and/or
- the first and/or second and/or third and/or fourth angle joint elements are provided with an envelope extending between the first face portion and the second face portion of the considered angle joint element, said envelope being open along the openings of the first and second face portions, as well as of the bending or curved portion, said envelope being adapted for receiving a portion of the plate and for enabling movement of said portion within said envelope, and/or
- the first face portions of two angle joint elements are maintained the one to the other, before pouring or casting the slabs, by at least at connecting system comprising a male element working with a female element, said connecting system being adapted so as to enable a relative sliding movement between the said male element and the female element at least after the slabs being cast, and/or
- the system is made of metal, and/or
- the means for transferring load at the crossover point is formed by at least two superposed plates, said plates being advantageously able to slide the one with respect to another, while optionally one plate is attached to one joint profile or element, advantageously to one angle joint profile or element, while another plate is attached to another joint profile or element, advantageously another angle joint profile or element, advantageously which is symmetrically located with respect to the centre line of the crossover point.

The invention further relates to a floor concrete surface comprising a series of cast-in-place slabs with metal joints therebetween, whereby relative movement of the metal joints occurs after the casting of the slabs, and whereby a series of crossover points are defined between adjacent cast-in-place slabs, said crossover points being enlarged after casting the slabs. In the floor of the invention, substantially all crossover points (for example all crossover points where a vehicle has to moved) are provided with a system according to the invention (as disclosed here above), thereby preventing crack formation adjacent to the crossover points.

Advantageously, a filler or a sealing product is injected at least partly in the crossover points.

The invention still relates to the use of a floor concrete surface according to the invention for stockage area, commercial area, and industrial area, as said floor enables a good load transfer at the crossover points, thereby preventing height displacement movement between adjacent slabs at the crossover point, and enabling a better running of vehicles above the crossover points.

Details and characteristics of systems of the invention and their use, as claimed in the attached claims, will appear from the following description in which reference is made to the attached drawings showing, as examples only, preferred embodiments of the invention.

DESCRIPTION OF PREFERRED EMBODIMENTS

Figure 1:
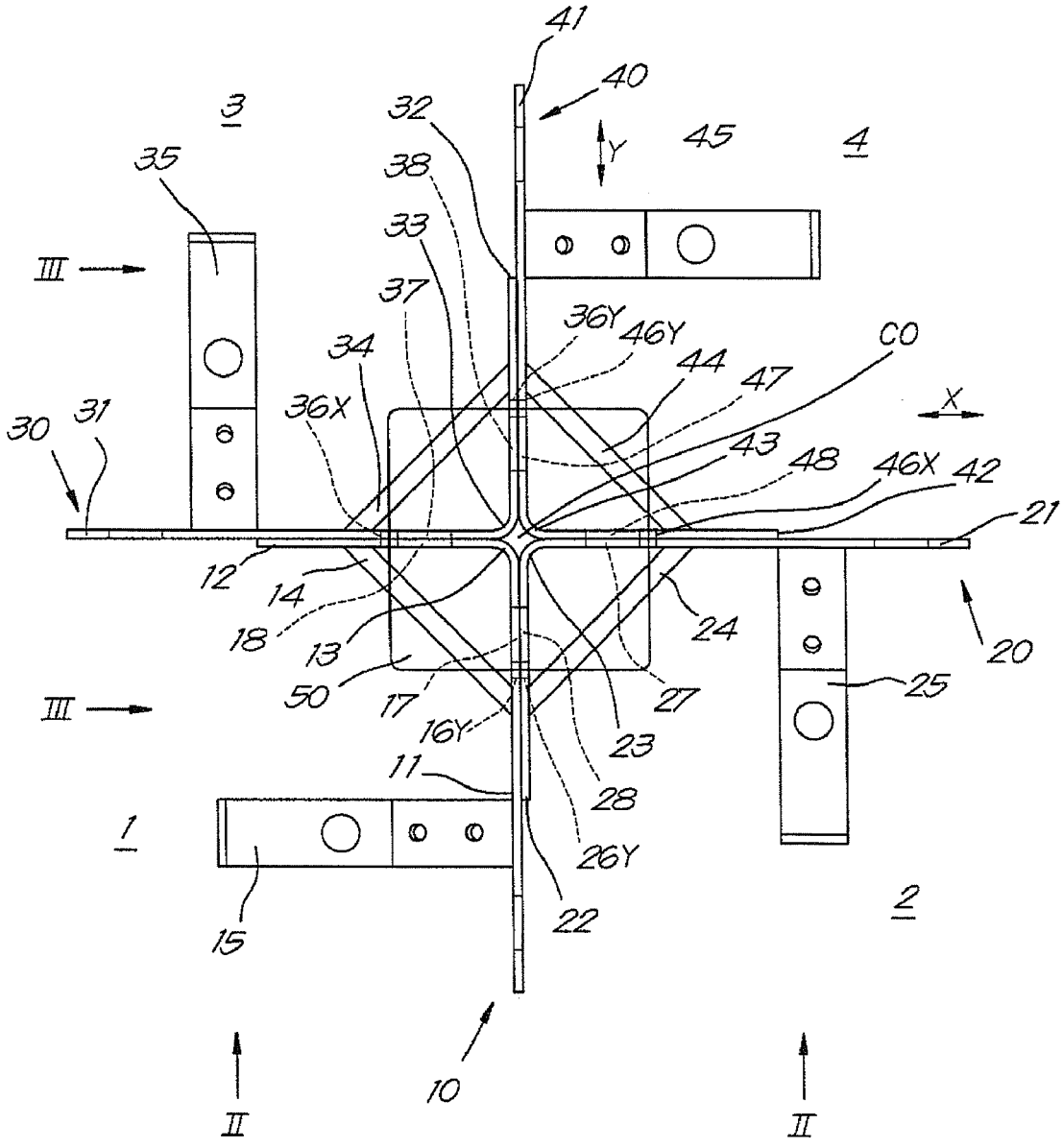
FIG. 1 is a top plan view of a first system of the invention.

The system of FIG. 1 is intended for transferring loads at a crossover point CO of a joint between cast-in-place slabs.

The system comprises:

a first cast-in-place slab 1, a second cats-in-place slab 2, a third cast-in-place slab 3, a fourth cast-in-place slab 4, a first angle joint element 10 located at a corner of the first cast-in-place slab 1, said first angle joint element comprising at least a first face portion 11, a second face portion 12, and a bending or curved portion 13 extending between the first and second face portions 11, 12, whereby said bending or curved portion 13 has a curvature with a radius of about 20 to 30 mm, said first and second face portions being further connected the one to the other by at least one anchor, here anchor rod 14 extending within the first cast-in-place slab, the first face portion 11 being further provided with an anchor, and in particular an anchor plate 15, a second angle joint element 20 located at a corner of the second cast-in-place slab 2, said second angle joint element 20 comprising at least a first face portion 21, a second face portion 22, and a bending or curved portion 23 extending between the first and second face portions 21, 22, whereby said bending or curved portion 23 has a curvature with a radius of about 20 to 30 mm, said first and second face portions being further connected the one to the other by at least one anchor rod 24 extending within the second cast-in-place slab, the first face portion 21 being further provided with an anchor plate 25, a third angle joint element 30 located at a corner of the first cast-in-place slab 3, said third angle joint element 30 comprising at least a first face portion 31, a second face portion 32, and a bending or curved portion 33 extending between the first and second face portions 31, 32, whereby said bending or curved portion 33 has a radius of curvature of about 20 to 30 mm, said first and second face portions being further connected the one to the other by at least one anchor rod 34 extending within the third cast-in-place slab, the first face portion 31 being further provided with an anchor plate 35, a fourth angle joint element 40 located at a corner of the fourth cast-in-place slab 4, said fourth angle joint element comprising at least a first face portion 41, a second face portion 42, and a bending or curved portion 43 extending between the first and second face portions 41, 42, whereby said bending or curved portion 43 has a curvature with a radius of about 20 to 30 mm, said first and second face portions being further connected the one to the other by at least one anchor rod 44 extending within the fourth cast-in-place slab 4, the first face portion 41 being further provided with an anchor plate 45, a plate 50 for transferring load at least between the cast-in-place slabs proximate or in the neighbourhood of the corners thereof, as well as through the crossover point CO.

The first face portions 11,21,31,41 of the angle joint elements 10,20,30,40 have a length L1 which is greater than the length L2 of the second face portions 12, 22, 32, 42. The Length L1 is advantageously at least 30 mm greater than the length L2, for example from 30 mm to 400 mm greater than the length L2. The length L1 is, however, advantageously less than 50 cm, for example comprised between 15 cm and 30 cm. The height H of the angle joint element is adapted to the height of the slabs, so that the top edges of the angle joint elements are located substantially at the top plane of the cast-in-place slabs. For each angle joint element, the first face portion extends substantially within a plane forming an angle of about 90° with the plane in which extends substantially the second face portion of the angle joint element considered.

The first face portion, the second face portion and the bending or curved portion of each angle joint element are provided with an opening 16, 26, 36, 46. The edges of said openings act as means for limiting the movement of the plate 50 in the three orthogonal directions, whereby before casting of the slabs, the movement of the plate in the direction X is limited between the end edges 26X and 16X, as well as 36X and 46X of the openings, while the movement of the plate 50 in the direction Y is limited between the end edges 16Y,26Y, 36Y and 46Y of the openings 16,26,36,46. The movement of the plate 50 in the direction Z is limited between the lower and upper edges of the openings 16,26,36,46. Furthermore, after casting the concrete, the concrete will also after retraction form chambers suitable for limiting the movement of the dowel plate. Another means for limiting the relative movement of the dowel plate toward the at least two joint elements along three orthogonal directions is to associate the joint profile or angle joint profile with an envelope for receiving a portion of the dowel plate.

The angle joint elements can be formed by folding a plate advantageously provided with one or more cuts, and/or by extruding an angle profile which is then cut. The angle joint elements can also be injected or moulded in a mould.

The thickness of the angle joint element can be comprised between 2 and 30 mm, said thickness can for example vary. For example the portion of the angle joint element intended to extend at the level of the top face of the cast in place slabs has a thickness greater than the thickness of the portion of the angle joint element adjacent to the bottom of the cast-in-place slabs. Optionally, the angle joint element can comprise a top portion and a bottom portion which are welded together, the top portion having a thickness greater than the thickness of the bottom portion. The thickness of the top portion is for example at least twice the thickness of the bottom portion. When the angle joint profile is made of a top portion welded to a bottom portion, said portions are placed the one with respect to the other, so that at least for the straight parts thereof, the lateral face of a straight part of the top portion which is not intended to be directed towards the cast-in-place slab (attached to the angle joint element considered) extends in the plane of the lateral face of a straight part of the bottom portion not directed towards the cast-in-place slab (attached to the angle joint element considered).

The angle joint elements are placed the one with respect to the other so that the first face portion 11,21,31,41 of one angle joint element is located in front of the second face portion of an adjacent angle joint element, and so that the openings 16,26,36,46 extend substantially in a same plane P1, advantageously in a substantially horizontal plane. The plate 50 (having a square shape and having for example a thickness comprised between 3 mm and 20 mm, for example between 4 mm and 15 mm, advantageously between 8 mm and 14 mm) is placed within the openings 16,26,36,46. The size of the plate is adapted so that at least two successive lateral edges of the plate are not contacting the end edges of two openings 16,26,36,46. The height W of the openings is advantageously adapted so as to be substantially equal to the thickness of the plate 50, said height W being however sufficient for enabling a relative movement of the plate 50 with respect to the angle joint elements after pouring the concrete for forming the cast-in-place slabs.

Each face portions of the angle joint elements 10,20,30,40 are provided with elongated slots 17,18,27,28, 37,38, 47, 48 extending all in a same plane P2 parallel to the plane P1.

The slot 17, 27, 37, 47 of a first face portion of one angle joint element extends at least partly in front of a slot 18, 28, 38, 48 of a second face element of another angle joint element.

The first face portion of one angle joint element is attached to the second face portion by a connecting element extending through the slots of said face portions, said connecting element comprising an elongated rod or flat element 60 with a head 61 adapted to contact the inner face of a face portion of one angle joint element, and a sheath 62 adapted to be mounted on the rod or flat element 60, said sheath 62 having an end contacting the inner face of the face portion of the other angle joint element. Said sheath 62 is fitted on the rod or flat element 60 so as to allow limited movement between the said face portions after the pouring of the concrete for forming the adjacent slabs, but also so as to prevent some movement between the said face portions before the pouring operation. For example, the sheath 62 is fitted on the rod or flat element 60 so as to enable a movement of the face portions away from each other, when the force (due to the retraction of the concrete) is higher than a predetermined force.

The rod or flat element 60 is advantageously connected to a dowel 63 extending in one slab, while the sheath is also advantageously connected to a dowel 64.

The first face portions of the angle joint elements (i.e. the portions having the greater length) are provided with elongated openings 70 for attaching the respective first face portion to joint profiles adapted to extend along a lateral edge of the slab. For example the joint profile 80 comprises two profile sections 81, 82, a first being intended to be directed towards one slab, while the other is intended to be directed to another adjacent slab. One end of one section extends outside the other section, whereby said end has an opening enabling the attachment of the profile to one first face portion of an angle joint element by a connecting piece, for example similar to the connecting piece 60,61,62.

Figure 6:
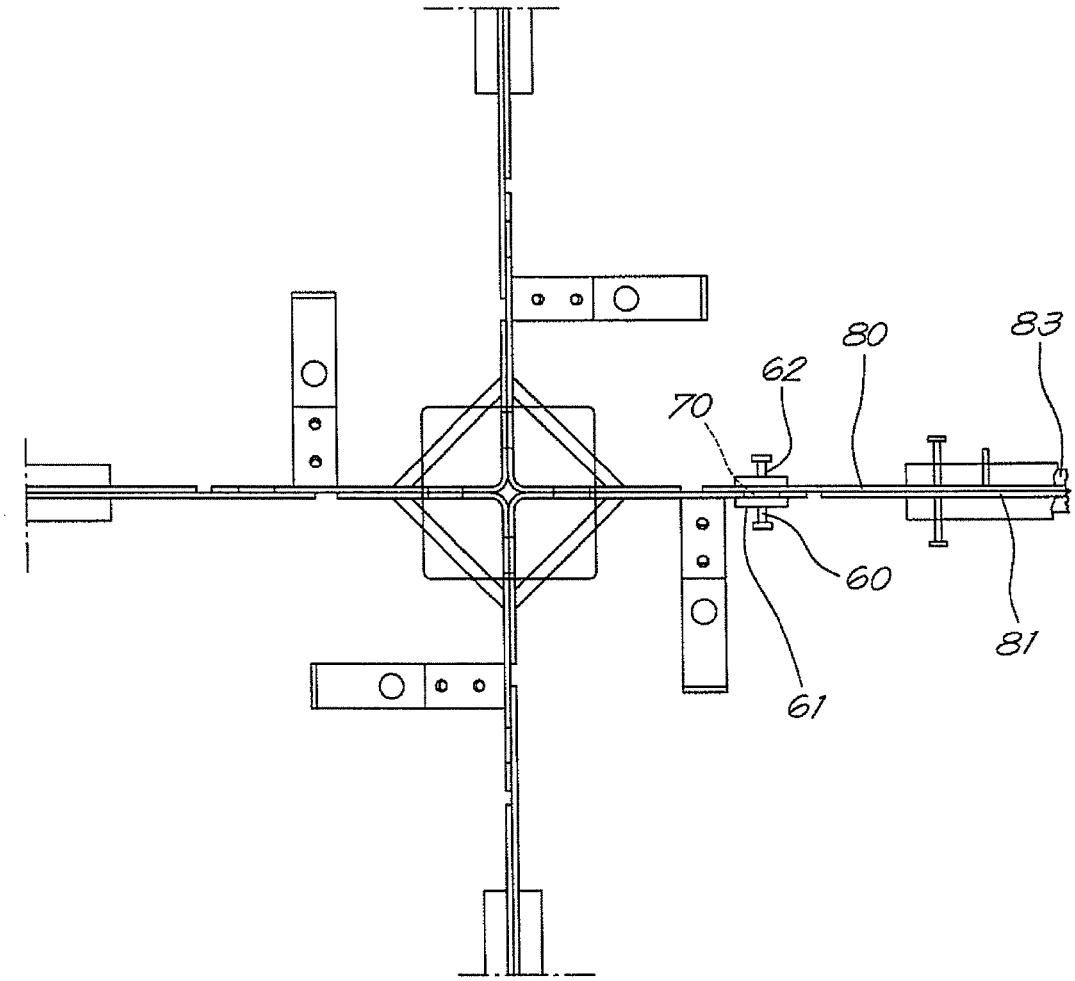
FIG. 6 is a partial top plan view of the system of FIG. 1 connected to joint profiles for lateral edges of cast-in-place slabs.
Figure 7:
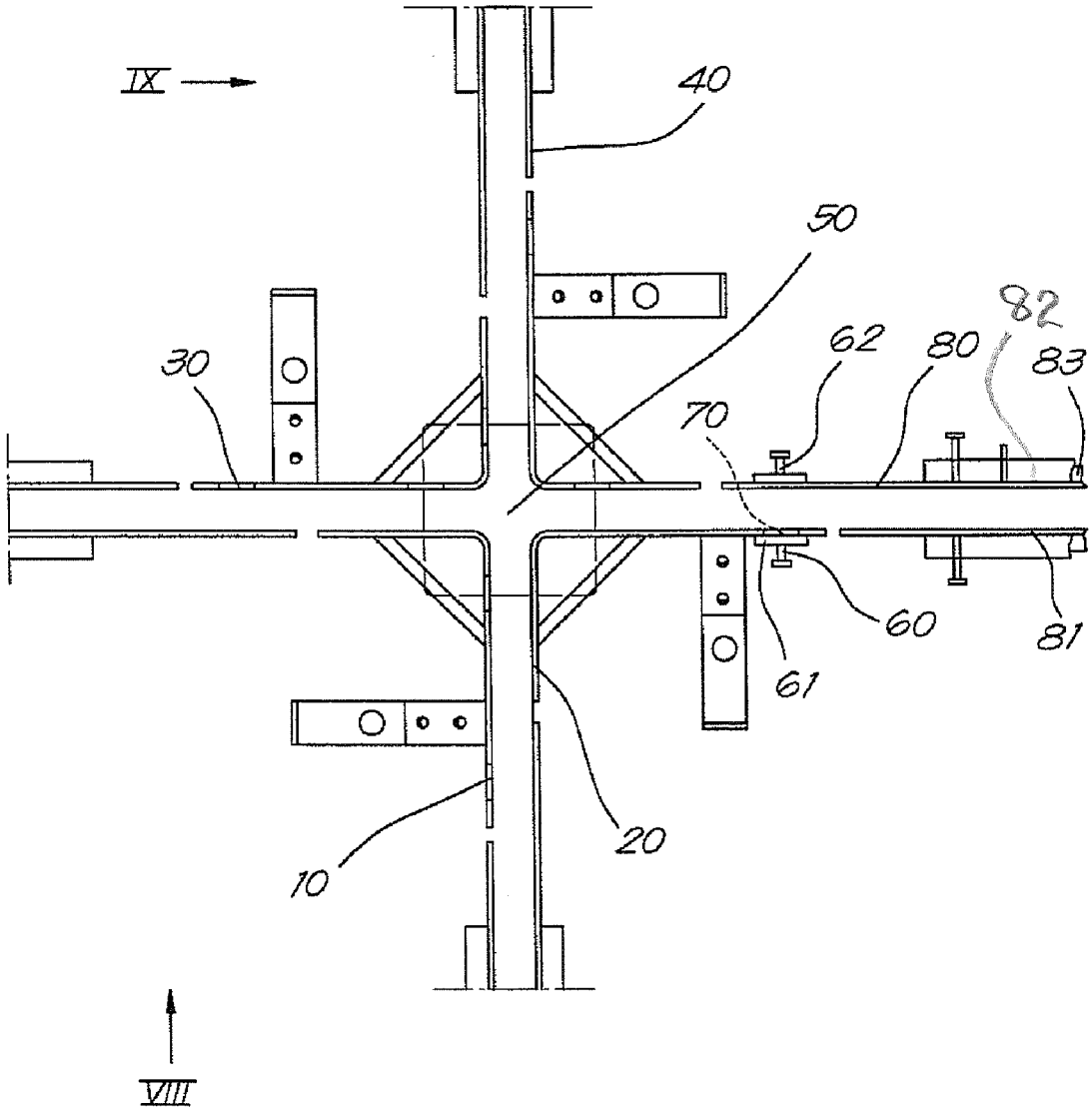
FIG. 7 is a top plan view of the system of FIG. 6, but after relative movements of the edge joint profiles.
Figure 8:
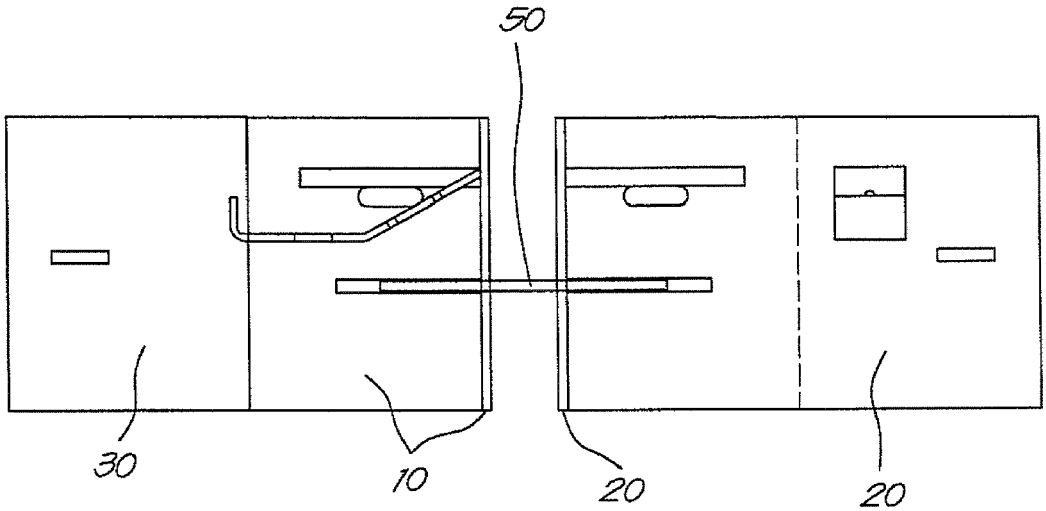
FIG. 8 is a side elevational view of the system of FIG. 7 taken in the direction of VIII of FIG. 7.
Figure 9:
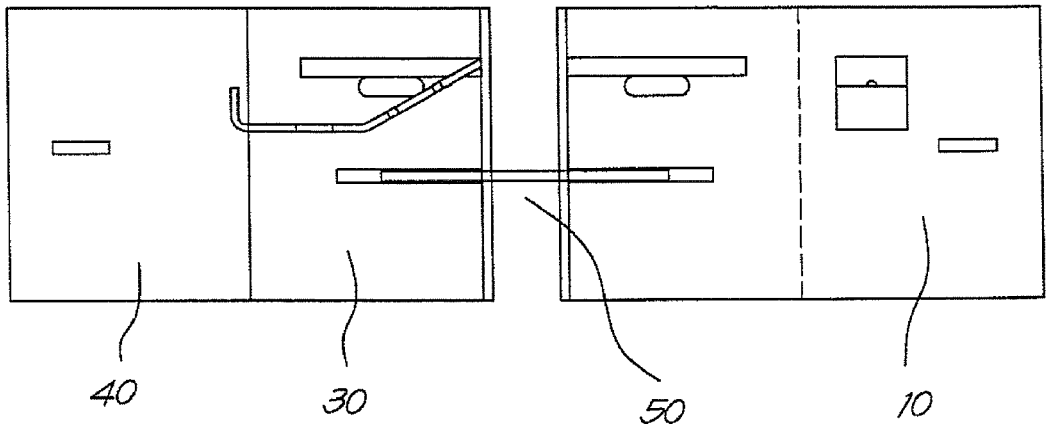
FIG. 9 is a side elevational view of the system of FIG. 7 taken in the direction of IX of FIG. 7.
Figure 10:
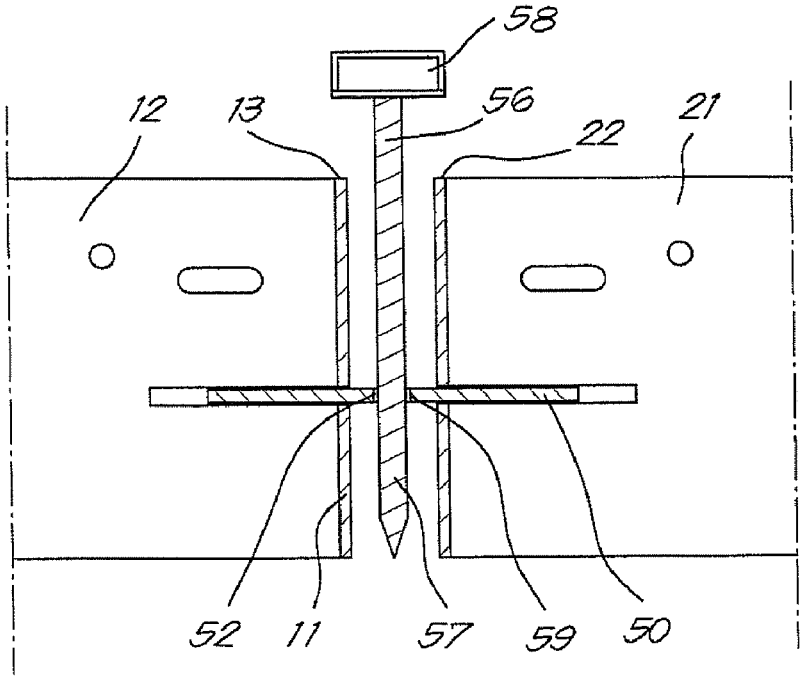
FIG. 10 is a vertical cross-sectional view of the system of FIG. 7, using the plate of FIG. 5C.

The profile sections 81, 82 are provided with means 83 for enabling load transfer from one profile section to the other profile section, as well as means for allowing a displacement of one profile away from the other due to contraction of the concrete. The edge joint profile may be joint profile 80 having profile sections 81, 82 as shown in FIGS. 6 and 7. The profiles are connected to an angle joint element by means of connecting elements 60, 61, 62 enabling possible movement of the profile section 81 away from the profile 82 (forming a gap between the profile sections) or a sliding movement of one profile section on the other (movement parallel to the longitudinal direction of the profile sections 81, 82) or a combination of such movements.

Figure 5A:
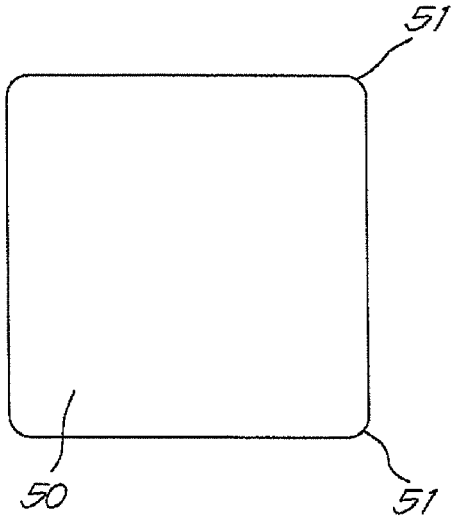
FIG. 5A is a top plan view of an embodiment of a plate for the system of FIG. 1.
Figure 5B:
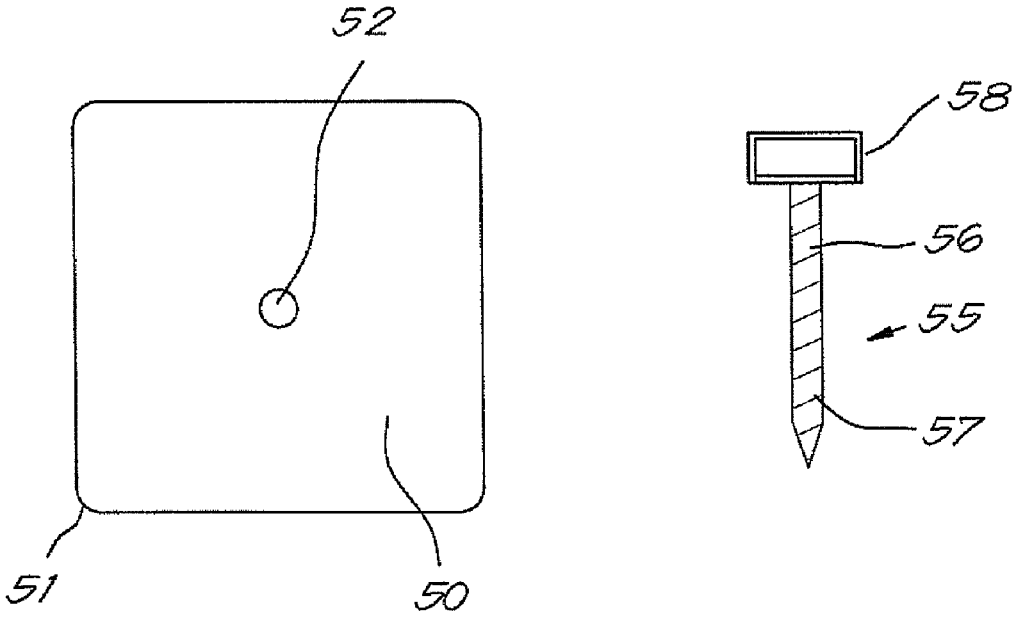
FIG. 5B is a top plan view of a second embodiment of a plate for the system of FIG. 1.
Figure 5C:
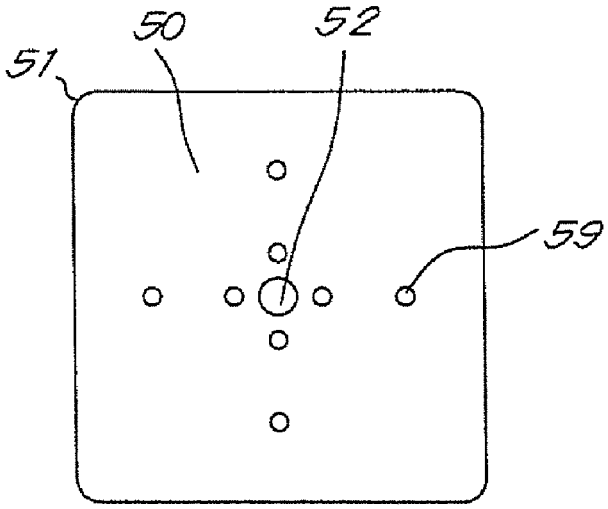
FIG. 5C is a top plan view of a third embodiment of a plate for the system of FIG. 1.

The plate 50 has a substantially rectangular shape, and preferably a substantially square form, such as shown in FIGS. 5A to 5C.

The plate 50 of FIG. 5A has for example a thickness of about 3 to 5 mm and the four ends 51 are rounded. For example said ends have a curvature with a radius of 5 mm to 20 mm. The thickness of the plate is lower than the height of the openings 16,26,36,46, so that relative movement between the plate 50 and the angle joint elements 10,20,30,40 is possible after pouring the concrete, for example due to a contraction thereof.

The plate 50 of FIG. 5B is similar to the embodiment of FIG. 5A, except that the plate is provided with a central hole 52. Said central hole 52 is adapted for receiving a part of a bearing element 55, for example for supporting the crossover point system, for the transport of the crossover point system, for adapting and/or controlling the position of the crossover point system. The bearing element 55 is provided, for example, with a rod 56 having thread 57 designed complemental to mate with a thread of the hole 55, whereby the rod can be screwed or unscrewed on the plate 50. The end of the rod 56 is provided with a handle 58, for facilitating the screwing operation and the transport of the crossover point system.

When screwing the rod 55 through the hole of the plate, the free end of the rod is adapted to rest on the ground surface, thereby ensuring that the crossover point is located at the right place, while the angle joint element are located at the right level. This is advantageous when pouring concrete near the corners of the slabs, and/or when trilling or vibrating the concrete before its hardening, as it enable to maintain a correct place of the crossover point.

After hardening of the concrete forming the different slabs, the angle joint elements are moved away the one from the other, whereby creating a gap. After removing the rod 56, the opening 52 is free whereby permitting the possible passage of a filler introduced in the gap, below the plate 52.

For the filling of filler below the plate 52, a pipe extending through the opening 52 can be used for injecting the filler under the plate 52.

The plate 50 of FIG. 5C is similar to the plate of FIG. 5B, except that the plate 52 is provided with supplemental holes 59 for facilitating the escape of air trapped below the plate when filling the gaps between the angle joint elements with a filler.

Figure 11:
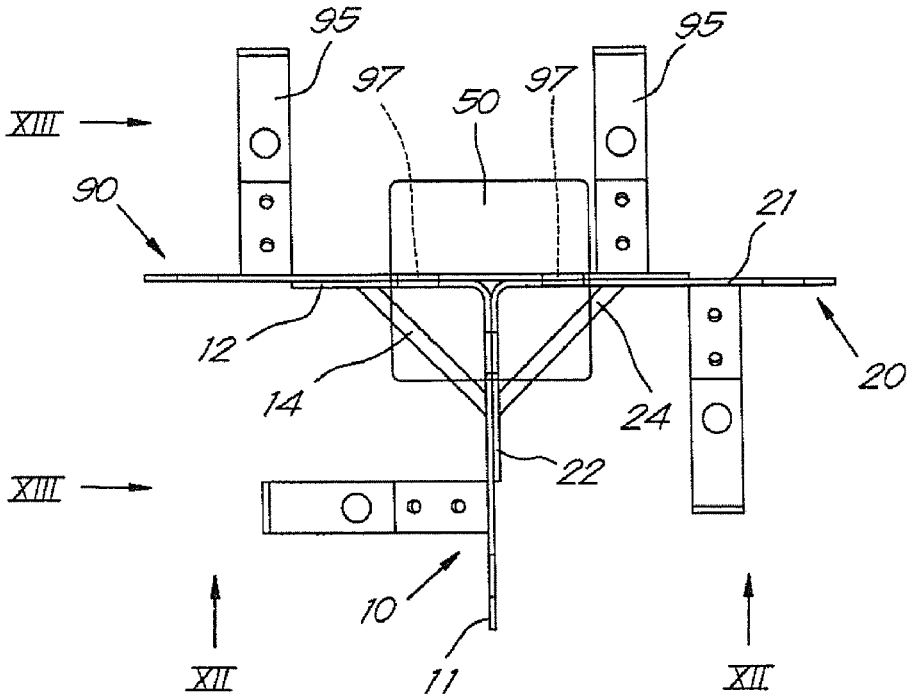
FIG. 11 is a top plan view of a further embodiment of the system similar to that shown in FIG. 1 with two angle joint elements and a linear joint element.

FIG. 11 is a view of a system similar to the system of FIG. 1, except that the system is adapted for a crossover point between three slabs 1,2,3.

Figure 12:
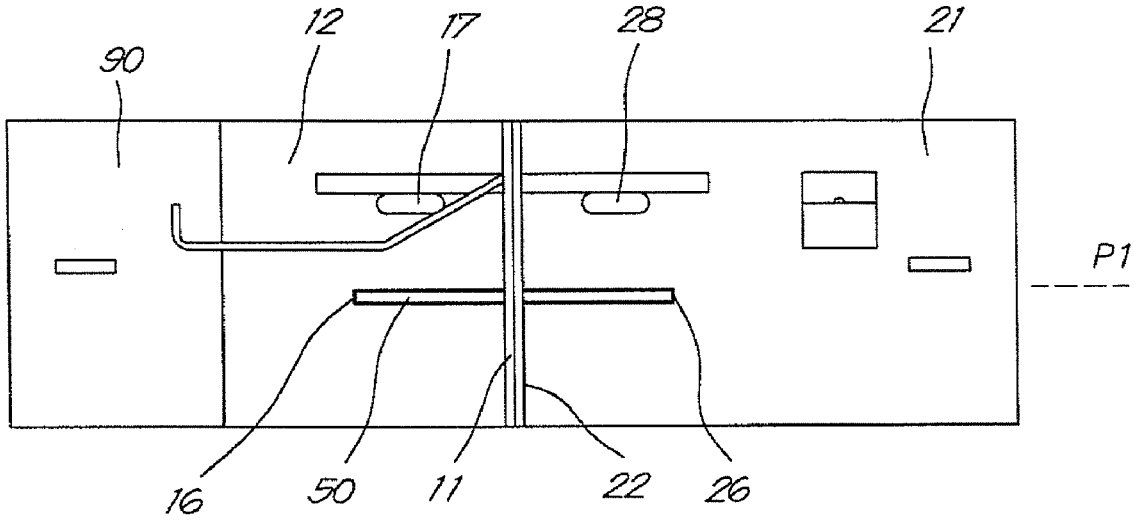
FIG. 12 is a side elevational view of the system of FIG. 11 taken in the direction of XII-XII of FIG. 11.
Figure 13:
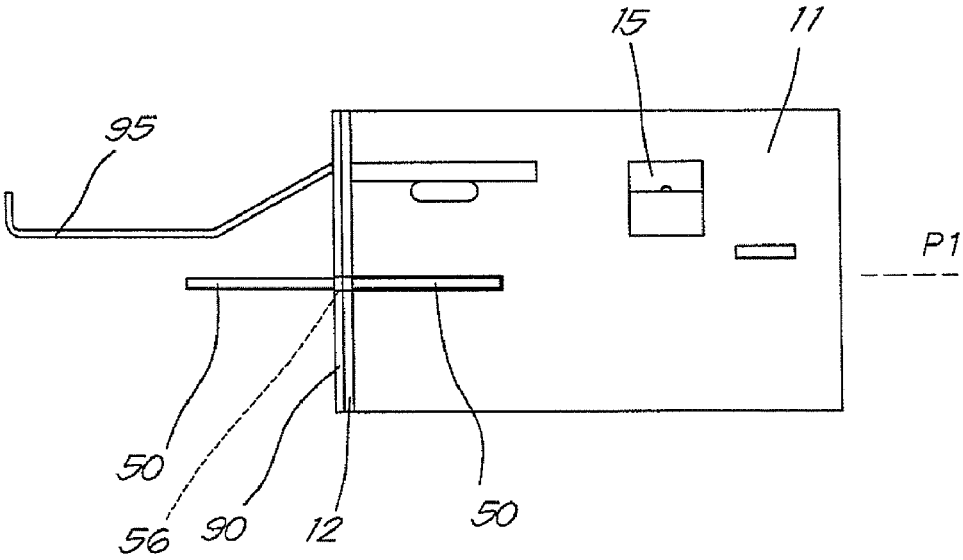
FIG. 13 is a side elevational view of the system of FIG. 11 taken in the direction of XIII-XIII of FIG. 11.
Figure 14:
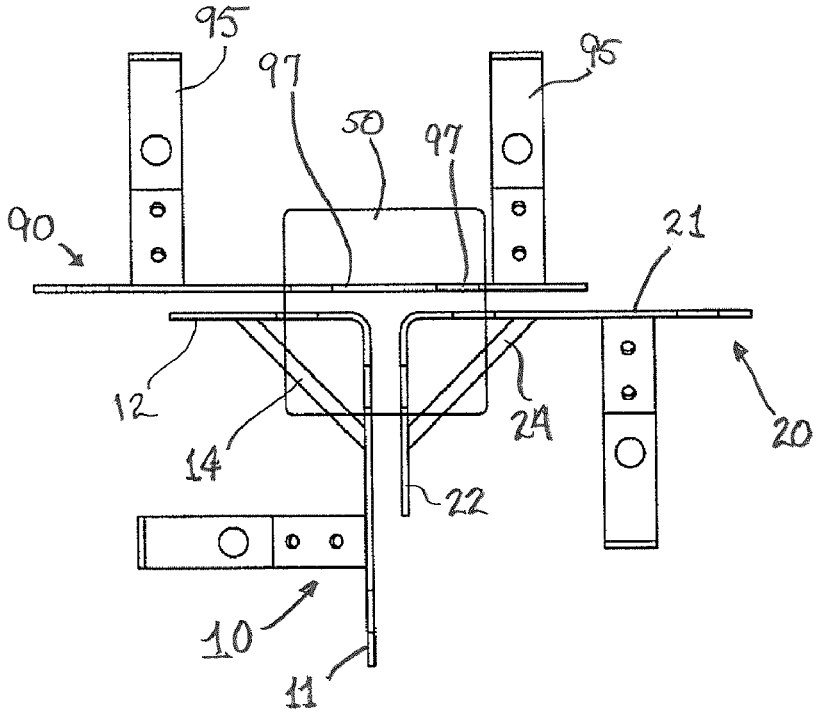
FIG. 14 is a top plan view of the system of FIG. 11 after relative movement of the angle joint elements.
Figure 15:
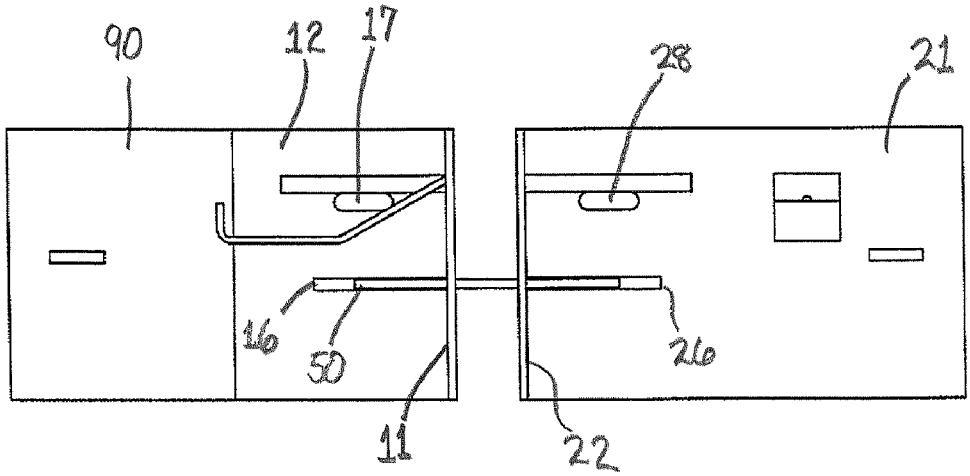
FIG. 15 is a side elevational view of the system of FIG. 11 taken in the direction of XII-XII of FIG. 11 after relative movement of the angle joint elements.
Figure 16:
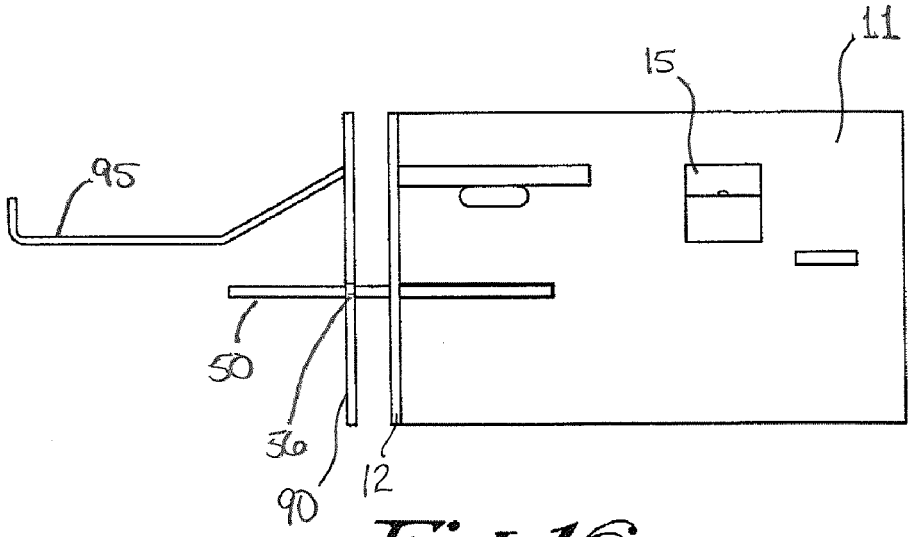
FIG. 16 is a side elevational view of the system of FIG. 11 taken in the direction of XIII-XIII of FIG. 11 after relative movement of the angle joint elements.

FIGS. 12 and 13 are lateral views of the system of FIG. 11.

The system of FIG. 11 comprises two angle joint elements 10,20 and a plane joint profile 90. The plane joint profile has an opening 96 adapted to be located at the same level and in front of the openings 16, 26, whereby enabling the placement of the plate 50.

The profile 90 is also provided with dowels 95 and is provided with slots 97 located respectively in front of a slot 17 of the first angle joint element and in front of a slot 28 of the second angle joint element.

Through said slots extends a connecting piece 60, 61, 62 of the type disclosed here before.

By using longitudinal joint profiles, as well as crossover joint systems of the invention, it is possible to achieve a floor concrete surface comprising a series of cast-in-place slabs with metal joints there between, whereby relative movement of the metal joints occurs after the casting of the slabs, and whereby a series of crossover points are defined between adjacent cast-in-place slabs, said crossover points being enlarged after casting the slabs. In said crossover points, a system of the type disclosed in the figures is advantageously used, for enabling an excellent transfer of charge or force between the slabs at the crossover points CO, and preventing the appearance of cracks which might form at the corner of the slabs.

Such a surface is suitable for flooring surfaces such as of stocking area, commercial area, and industrial area.

Figure 4:
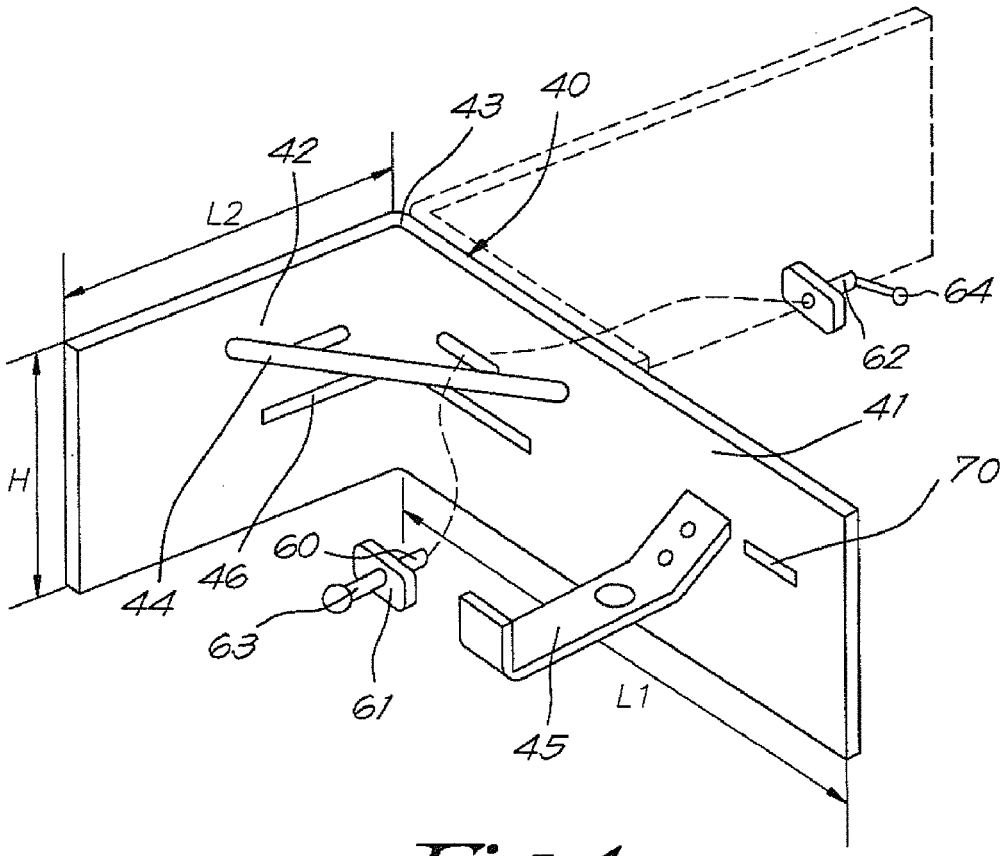
FIG. 4 is a perspective view of an angle joint element of the system of FIG. 1.
Figure 17:
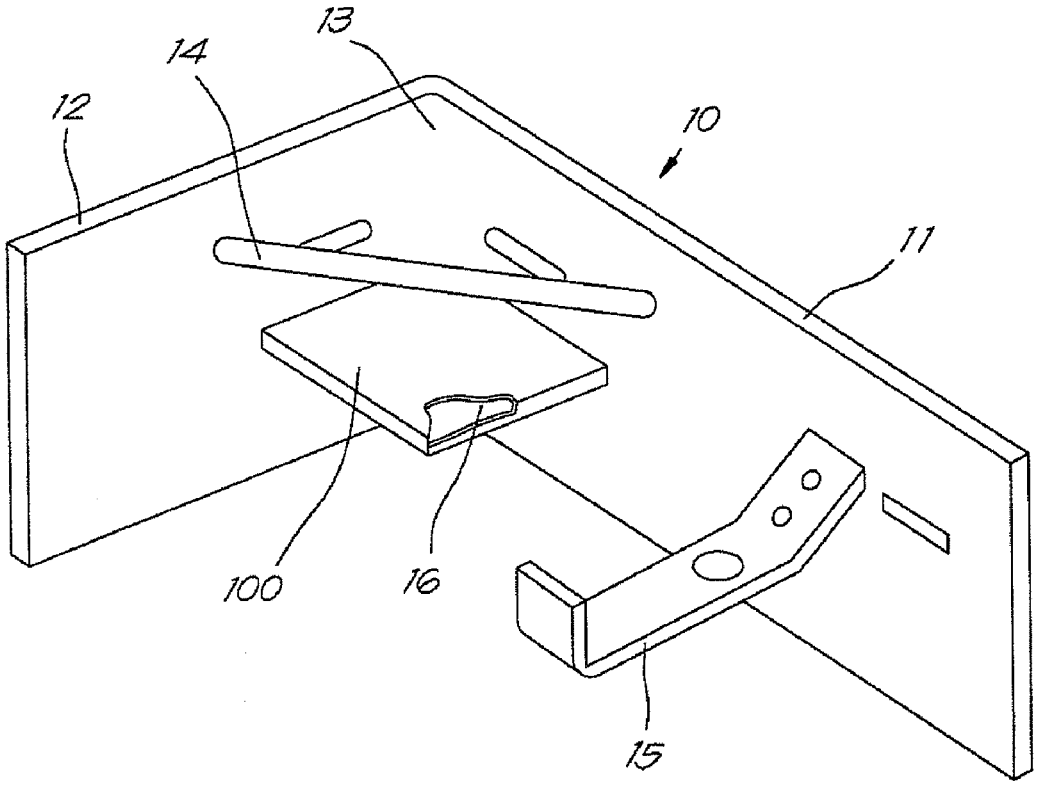
FIG. 17 is a perspective view of another embodiment of an angle joint element for use in the system of the present invention.
Figure 18:
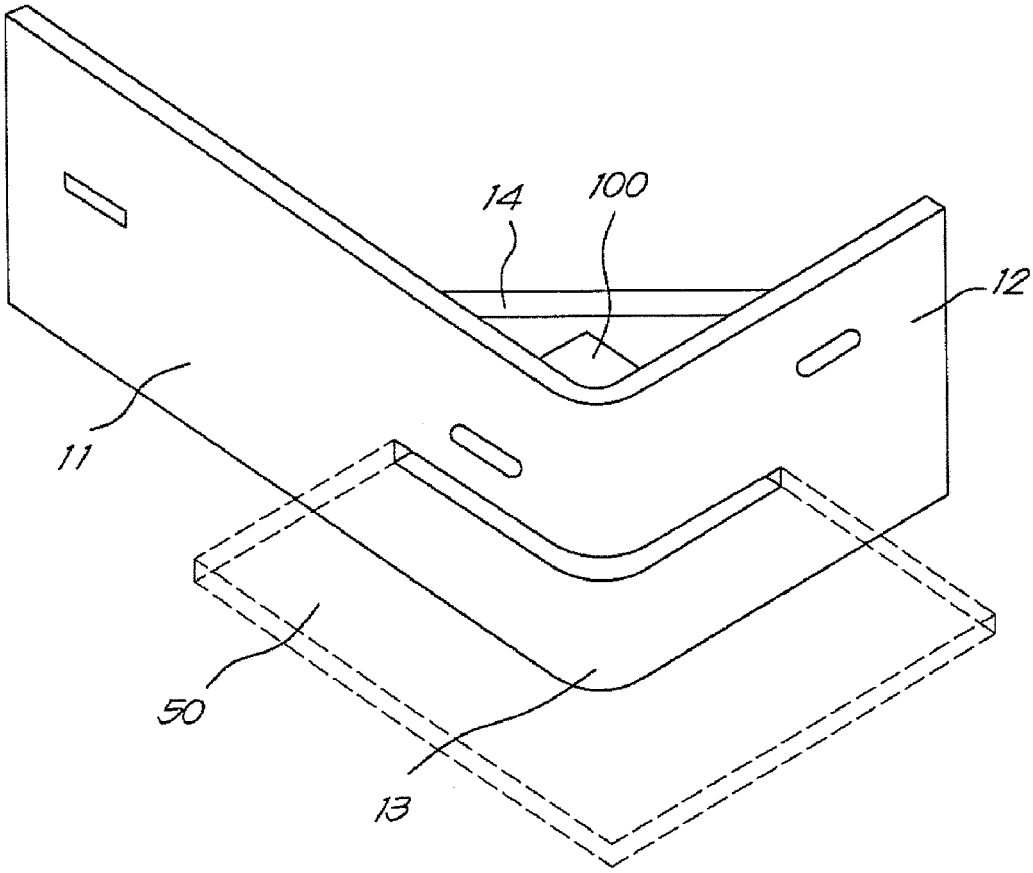
FIG. 18 is a perspective view of a further embodiment of an angle joint element for use in the system of the present invention.

FIGS. 17 and 18 are perspective views of an angle joint element (10) similar to the element shown in FIG. 4, except that an open envelope 100 extends between the first and second face portions 11,12, the envelope 100 being open along the opening 16 and having a chamber adapted for receiving the plate 50 and for allowing movement of the plate within the chamber 101, for example when one angle joint element moves with respect to another angle joint element.

Figure 19:
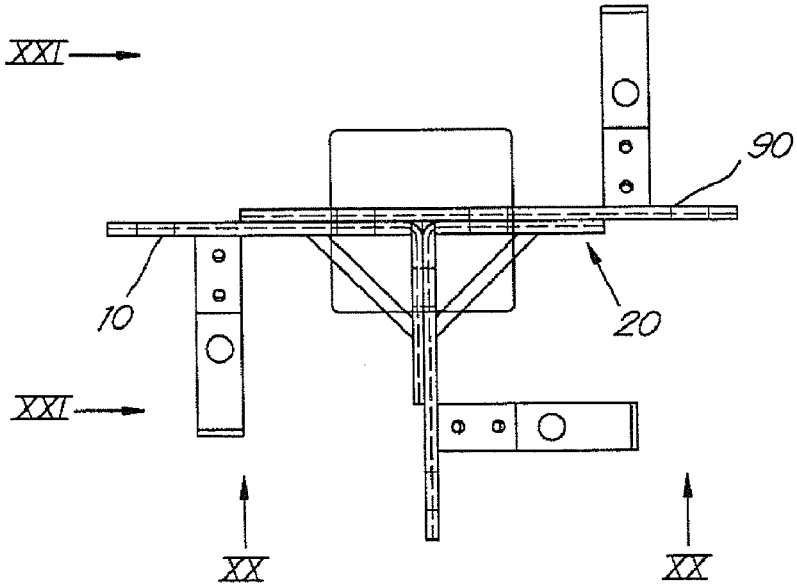
FIG. 19 is a top plan view of a further embodiment of the system of the present invention similar to the embodiment of FIG. 11.
Figure 20:
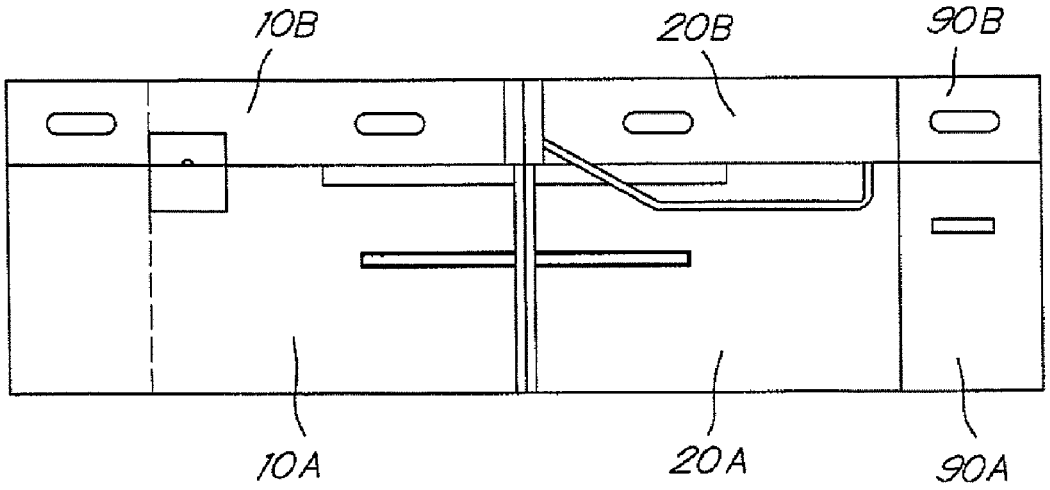
FIG. 20 is a side elevational view of the system of FIG. 19 taken in the direction of XX-XX of FIG. 19.
Figure 21:
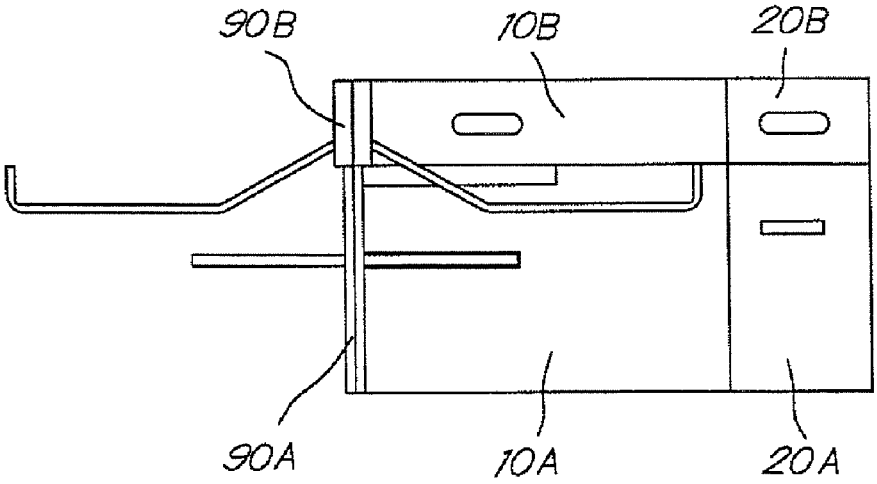
FIG. 21 is a side elevational view of the system of FIG. 19 taken in the direction of XXI-XXI of FIG. 19.

FIGS. 19 to 21 are views similar to FIGS. 11 to 13 of a further embodiment similar to the embodiment of FIG. 11. In said embodiment, each joint element 10,20,90 consists of a bottom part 10A,20A,90A and a top part 10B,20B,90B welded together. The top part 10B,20B,90B is thicker than the bottom part 10A,20A,90A.

Figure 2:
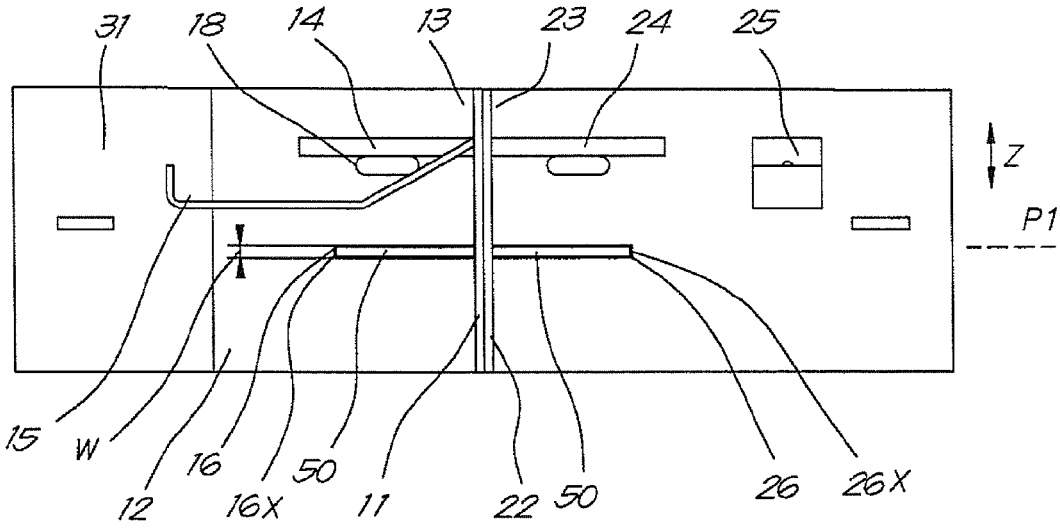
FIG. 2 is a side elevational view taken in the direction of II-II of FIG. 1.
Figure 3:
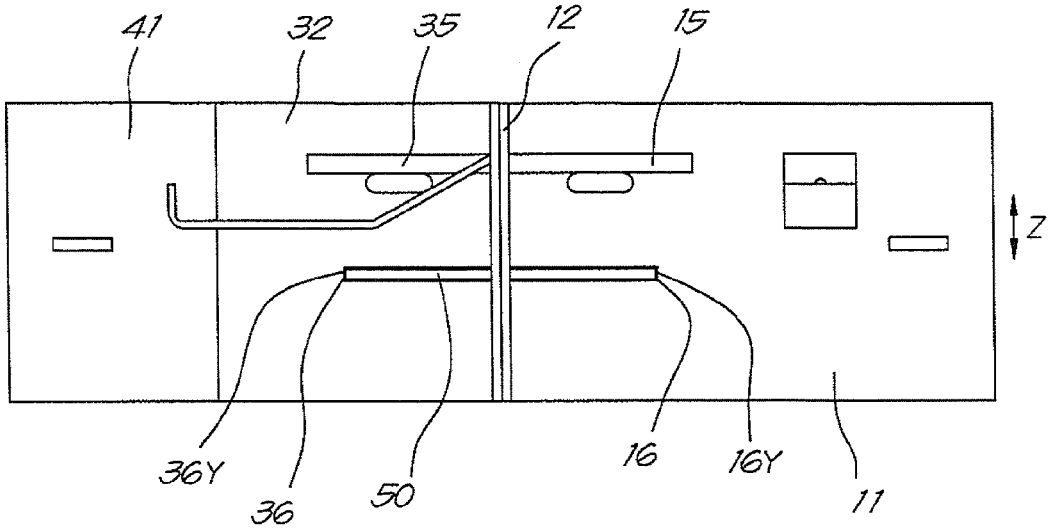
FIG. 3 is a side elevational view taken in the direction of III-III of FIG. 1.
Figure 22:
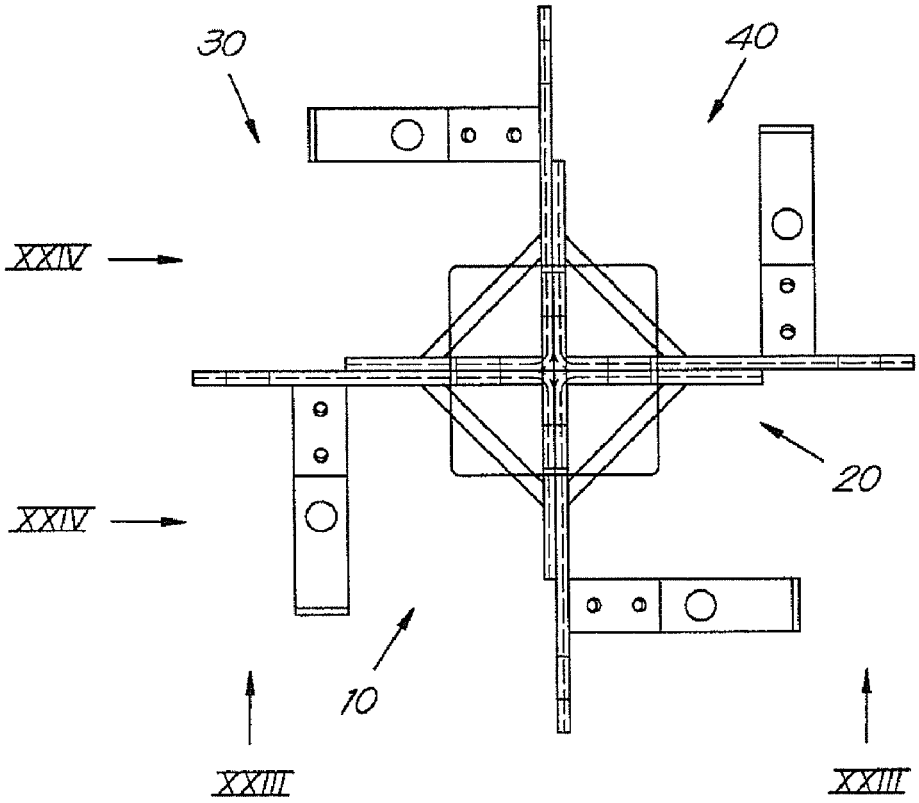
FIG. 22 is a top plan view of a still further embodiment of the system of the present invention similar to the embodiment of FIG. 1.
Figure 23:
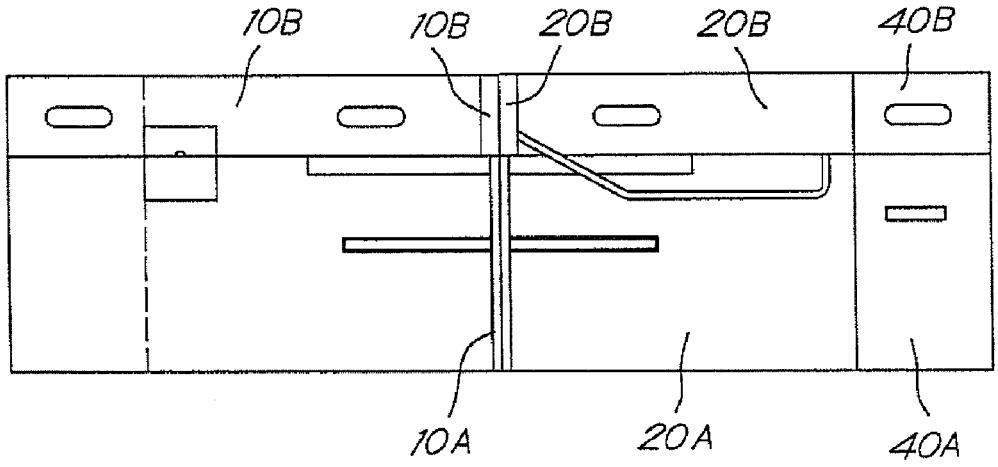
FIG. 23 is a side elevational view of the system of FIG. 22 taken in the direction of XXIII-XXIII of FIG. 22.
Figure 24:
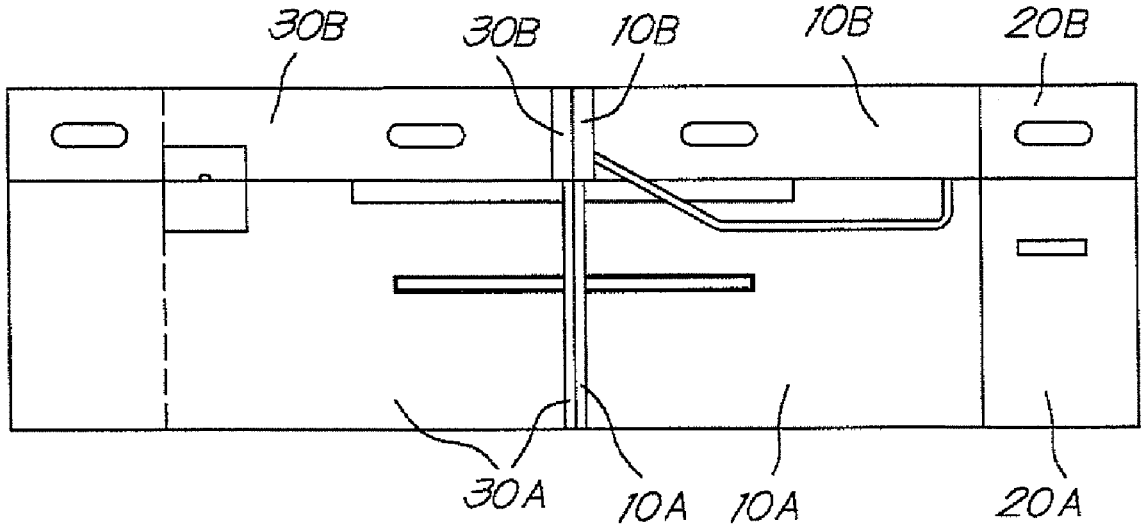
FIG. 24 is a side elevational view of the system of FIG. 22 taken in the direction of XXIV-XXIV of FIG. 22.

FIGS. 22 to 24 are views similar to the views of FIGS. 1 to 3 of still a further embodiment similar to the embodiment of FIG. 1. In said embodiment, each joint element 10,20,30,40 consists of a bottom part 10A,20A,90A and a top part 10B, 20B,90B welded together. The top part 10B,20B,90B is thicker than the bottom part 10A,20A,90A.

The top parts 10B,20B,30B,40B are for example formed by two plate sections which are welded together at one of their ends.

What I claim is:

1. A metal system for transferring loads at a crossover point of a joint between at least first, second and third cast-in-place slabs, said system comprising:

at least one dowel plate; and at least a first angle joint element attached to the first cast-in-place slab, a second angle joint element attached to the second cast-in-place slab, and a third joint element attached to the third cast-in-place slab, whereby relative movement between at least two of said joint elements occurs during the hardening of the cast-in-place slabs, and wherein the said first, second and third joint elements and at least one dowel plate are adapted so that, after hardening of the cast-in-place slabs and the said relative movement between at least two of said joint elements, the dowel plate has at least a first portion extending within a first piece selected from the group consisting of the first cast-in-place slab after its hardening and a casing attached to the first cast-in place slab after its hardening, a second portion extending within a second piece selected from the group the second cast-in-place slab after its hardening and a casing attached to the second cast-in place slab after its hardening, and a third portion extending within a third piece selected from the group consisting of the third cast-in-place slab after its hardening and a casing attached to the third cast-in place slab after its hardening, and wherein at least a first member selected from the group consisting of one of said joint elements and the casing attached to said one of said joint elements, and a second member selected from the group consisting of another of said joint elements and the casing attached to said another of said joint elements are each provided with means for limiting the relative movements of the dowel plate towards the said at least two joint elements along three orthogonal directions, wherein at least the first angle joint element and the second angle joint element each comprise a profile having a first face portion, a second face portion and an intermediate portion selected from the group consisting of a bent portion and a curved portion extending between the first face portion and the second face portion of the respective angle joint element, wherein at least the first angle joint element and the second angle joint element are each provided with an opening extending in their respective intermediate portion, partly in their respective first face portion and partly in their respective second face portion, wherein the third joint element is provided with an opening, wherein the openings of each of the first angle joint element, the second angle joint element, and the third angle joint element extend substantially in the same plane, and wherein the dowel plate is a plate element extending through the said openings of the first and second angle joint elements and the said opening of the third joint element.

2. The system of claim 1, comprising at least:

a first angle joint element located at a corner of the first cast-in-place slab, said first angle joint element comprising at least a first face portion and a second face portion connected the one to the other, and at least one anchor means adapted to extend within the first cast-in-place slab (1), a second angle joint element located at a corner of the second cast-in-place slab, said second angle joint element comprising at least a first face portion and a second face portion connected the one to the other, and at least one anchor means adapted to extend within the second cast-in- place slab, wherein the second face portion of the second angle joint element extends substantially in front of the first face portion of the first angle joint element, a third joint element located along a part selected from the group consisting of an edge of the third cast-in-place slab and a corner of the third cast-in-place slab, said third joint element comprising at least a face portion and at least one anchor means adapted to extend within the third cast-in-place slab, wherein said face portion of the third joint element extends in front of at least one face portion selected from the group consisting of one of the first and second face portions of the first angle joint element and one of the first and second face portions of the second angle joint element, and at least one dowel plate acting as means for transferring load at least between the first, second and third cast-in-place slabs proximate the first and second angle joint elements.

3. The system of claim 2, in which at least one of the angle joint elements is provided with an envelope extending between the first face portion and the second face portion of the considered angle joint element, said envelope being open along the openings of the first and second face portions, as well as of along the intermediate portion, said envelope being adapted for receiving a portion of the dowel plate and for enabling movement of said portion of the dowel plate within said envelope.

4. The system of claim 2, in which at least the first angle joint element and the second angle joint element comprise each a profile having an intermediate portion selected from the group consisting of a bent portion and a curved portion extending between the first face portion and the second face portion of the profile considered, wherein said intermediate portion connects together the first and second face portions of the profile considered, and wherein said intermediate portion has a curvature with a radius of at least 3 mm, in which the first angle joint element and the second angle joint element are each provided with an opening extending in their intermediate portion, partly in their first face portion and partly in their second face portion, while the third joint element is provided with an opening, wherein the openings of the first and second angle joint elements and the opening of the third joint element extend substantially in a same plane, and in that the dowel plate acting as means for transferring load between the cast-in-place slabs is a plate element extending through the said openings of the first and second angle joint elements, and of the third joint element.

5. The system of claim 1, in which at least the first angle joint element and the second angle joint element comprise each a profile having an intermediate portion selected from the group consisting of a bent portion and a curved portion extending between the first face portion and the second face portion of the profile considered, wherein said intermediate portion connects together the first and second face portions of the profile considered, wherein said intermediate portion has a curvature with a radius comprised between 4 mm and 40 mm, in which the first angle joint element and the second angle joint element are each provided with an opening extending in their intermediate portion, partly in their first face portion and partly in their second face portion, while the third joint element is provided with an opening, wherein the openings of the first and second angle joint elements and the opening of the third joint element extend substantially in a same plane, and in that the dowel plate acting as means for transferring load between the cast-in-place slabs is a plate element extending through the said openings of the first and second angle joint elements, and of the third joint element.

6. The system of claim 1, comprising at least:

a first angle joint element located at a corner of the first cast-in-place slab, said first angle joint element comprising at least a first face portion and a second face portion connected the one to the other, and at least one anchor means adapted to extend within the first cast-in-place slab, a second angle joint element located at a corner of the second cast-in-place slab, said second angle joint element comprising at least a first face portion and a second face portion connected the one to the other, and at least one anchor means adapted to extend within the second cast-in-place slab, wherein the second face portion of the second angle joint element extends substantially in front of the first face portion of the first angle joint element, a third joint element located along a part selected from the group consisting of an edge of the third cast-in-place slab and a corner of the third cast-in-place slab, said third joint element comprising at least a face portion and at least one anchor means adapted to extend within the third cast-in-place slab, wherein said face portion of the third joint element extends in front of at least one face portion selected from the group consisting of one of the first and second face portions of the first angle joint element and one of the first and second face portions of the second angle joint element, and at least one dowel plate acting as means for transferring load at least between the first, second and third cast-in-place slabs proximate the first and second angle joint elements, wherein at least one rod extends between the first face portion of at least one of the first, second and third joint elements and the second face portion of another of the first, second and third joint elements.

7. The system of claim 1 in which the dowel plate has a planar shape selected from the group consisting of square shape, a rectangular shape, a circular shape, an oval shape, portions thereof and combinations thereof.

8. The system of claim 1, in which at least the first, second and third cast-in-place slabs have each lateral edges each provided with an edge joint profile, wherein the first, second and third joint elements are each provided with means for connecting the considered joint element to at least one edge joint profile.

9. The system of claim 1, comprising at least:

a first angle joint element located at a corner of the first cast-in-place slab, said first angle joint element comprising at least a first face portion and a second face portion connected the one to the other, and at least one anchor means adapted to extend within the first cast-in-place slab, a second angle joint element located at a corner of the second cast-in-place slab, said second angle joint element comprising at least a first face portion and a second face portion connected the one to the other, and at least one anchor means adapted to extend within the second cast-in-place slab, wherein the second face portion of the second angle joint element extends substantially in front of the first face portion of the first angle joint element, a third joint element located along a part selected from the group consisting of an edge of the third cast-in-place slab and a corner of the third cast-in-place slab, said third joint element comprising at least a face portion and at least one anchor means adapted to extend within the third cast-in-place slab, wherein said face portion of the third joint element extends in front of at least one face portion selected from the group consisting of one of the first and second face portions of the first angle joint element and one of the first and second face portions of the second angle joint element, and at least one dowel plate acting as means for transferring load at least between the first, second and third cast-in-place slabs proximate the first and second angle joint elements, in which the first face portion of the first angle joint element and the second face portion of the second angle joint element are maintained the one to the other, before pouring or casting the slabs, by at least at connecting system comprising a male element working with a female element, said connecting system being adapted so as to enable a relative sliding movement between the said male element and the female element at least after the slabs being cast.

10. The system of claim 1, in which each of said first and second angle joint elements comprise a first face portion and a second face portion connected the one to the other, in which each of said first and second angle joint elements is provided with an opening extending partly within the first face portion and partly within the second face portion of the considered angle joint element, and in which each of said first and second angle joint elements is provided with an envelope extending between the first face portion and the second face portion of the considered angle joint element, said envelope being open along the opening of the considered angle joint element, said envelope being adapted for receiving a portion of the dowel plate and for enabling movement of said portion of the dowel plate within said envelope.

11. A metal system for transferring loads at a crossover point of a joint between at least a first, a second, a third and a fourth cast-in-place slabs, said system comprising at least one dowel plate;

at least a first angle joint element attached to the first cast-in-place slab, a second angle joint element attached to the second cast-in-place slab, a third joint element attached to the third cast-in-place slab, and a fourth joint element attached to the fourth cast-in-place slab, whereby relative movement between at least three angle joint elements occurs during the hardening of the cast-in-place slabs, wherein the first, second, third and fourth joint elements are each provided with an opening, wherein the first, second, third and fourth angle joint elements and the dowel plate are adapted so that, after hardening of the cast-in-place slabs and the said relative movement between the angle joint elements, the dowel plate has at least a first portion extending through the opening of the first angle joint element within a first piece selected from the group consisting of the first cast-in-place slab after its hardening and a casing attached to the first cast-in place slab after its hardening, a second portion extending through the opening of the second angle joint element within a second piece selected from the group consisting of the second cast-in-place slab after its hardening and a casing attached to the second cast-in place slab after its hardening, a third portion extending through the opening of the third angle joint element within a third piece selected from the group consisting of the third cast-in-place slab after its hardening and a casing attached to the third cast-in place slab after its hardening, and a fourth portion extending through the opening of the fourth angle joint element within a fourth piece selected from the group consisting of the fourth cast-in-place slab after its hardening and a casing attached to the fourth cast-in place slab after its hardening, and wherein a first member selected from the group consisting from the group consisting of said first angle joint element and the casing attached to said first angle joint element, a second member selected from the group consisting from the group consisting of said second angle joint element and the casing attached to said second angle joint element, a third member selected from the group consisting from the group consisting of said third angle joint element and the casing attached to said third angle joint element, and a fourth member selected from the group consisting from the group consisting of said fourth angle joint element and the casing attached to said fourth angle joint element are each provided with means for limiting the relative movements of the dowel plate towards the said first, second, third and fourth angle joint elements along three orthogonal directions.

12. The system of claim 11, comprising at least:

a first angle joint element located at a corner of the first cast-in-place slab, said first angle joint element comprising at least a first face portion and a second face portion connected the one to the other, and at least one anchor means adapted to extend within the first cast-in-place slab, a second angle joint element located at a corner of the second cast-in-place slab, said second angle joint element comprising at least a first face portion and a second face portion connected the one to the other, and at least one anchor means adapted to extend within the second cast-in-place slab, wherein the second face portion of the second angle joint element extends substantially in front of the first face portion of the first angle joint element, a third joint element located at a corner of the third cast-in-place slab, said third joint element comprising at least a first portion and a second face portion connected the one to the other, and at least one anchor means adapted to extend within the third cast-in-place slab, wherein the second face portion of the third angle joint element extends substantially in front of the first face portion of the second angle joint element, a fourth joint element located at a corner of the fourth cast-in-place slab, said fourth joint element comprising at least a first face portion and a second face portion connected the one to the other, and at least one anchor means adapted to extend within the fourth cast-in-place slab, wherein the second face portion of the fourth angle joint element extends substantially in front of the first face portion of the third angle joint element, and at least one dowel plate acting as means for transferring load at least between the first, second, third and fourth cast-in-place slabs proximate the said first, second, third and fourth angle joint elements.

13. The system of claim 12, in which at least the first angle joint element, the second angle joint element, the third angle joint element and the fourth angle joint element comprise each a profile having an intermediate portion selected from the group consisting of a bent portion and a curved portion extending between the first face portion and the second face portion of the profile considered, wherein said intermediate portion connects together the first and second face portions of the profile considered, wherein said intermediate portion has a curvature with a radius of at least 3 mm, in which the first angle joint element, the second angle joint element, the third angle joint element and the fourth angle joint element are each provided with an opening extending in their intermediate portion, partly in their first face portion and partly in their second face portion, wherein the openings of the first, second, third and fourth angle joint elements extend substantially in a same plane, and in which the dowel plate acting as means for transferring load between the first, second, third and fourth cast-in-place slabs is a plate element extending through the said openings of the said first, second, third and fourth angle joint elements.

14. The system of claim 11, comprising at least:

a first angle joint element located at a corner of the first cast-in-place slab, said first angle joint element comprising at least a first face portion and a second face portion connected the one to the other by an intermediate portion, and at least one anchor means adapted to extend within the first cast-in-place slab, a second angle joint element located at a corner of the second cast-in-place slab, said second angle joint element comprising at least a first face portion and a second face portion connected the one to the other by an intermediate portion, and at least one anchor means adapted to extend within the second cast-in-place slab, wherein the second face portion of the second angle joint element extends substantially in front of the first face portion of the first angle joint element, a third joint element located at a corner of the third cast-in-place slab, said third joint element comprising at least a first face portion and a second face portion connected the one to the other by an intermediate portion, and at least one anchor means adapted to extend within the third cast-in-place slab, wherein the second face portion of the third angle joint element extends substantially in front of the first face portion of the second angle joint element, a fourth joint element located at a corner of the fourth cast-in-place slab, said fourth joint element comprising at least a first face portion and a second face portion connected the one to the other by an intermediate portion, and at least one anchor means adapted to extend within the fourth cast-in-place slab, wherein the second face portion of the fourth angle joint element extends substantially in front of the first face portion of the third angle joint element, and at least one dowel plate acting as means for transferring load at least between the first, second, third and fourth cast-in-place slabs proximate the said first, second, third and fourth angle joint elements, wherein at least the first angle joint element, the second angle joint element, the third angle joint element and the fourth angle joint element each include a profile having an intermediate portion selected from the group consisting of a bent portion and a curved portion extending between the first face portion and the second face portion of the profile considered, wherein said intermediate portion connects together the first and second face portions of the profile considered, wherein said intermediate portion has a curvature with a radius comprised between 4 mm and 40 mm, wherein the first angle joint element, the second angle joint element, the third angle joint element and the fourth angle joint element are each provided with an opening extending in their intermediate portion, partly in their first face portion and partly in their second face portion, wherein the openings of the first, second, third and fourth angle joint elements extend substantially in a same plane, and wherein the dowel plate acting as means for transferring load between the first, second, third and fourth cast-in-place slabs is a plate element extending through the said openings of the said first, second, third and fourth angle joint elements.

15. The system of claim 14, in which each of said first, second, third and fourth angle joint elements is provided with an envelope extending between the first face portion and the second face portion of the considered angle joint element, said envelope being open along the openings of the first and second face portions, as well as of along the intermediate portion, said envelope being adapted for receiving a portion of the dowel plate and for enabling movement of said portion of the dowel plate within said envelope.

16. The system of claim 11, in which each of said first, second, third and fourth angle joint elements comprises a first face portion and a second face portion connected the one to the other, in which each of said first, second, third and fourth angle joint elements is provided with an opening extending partly within the first face portion and partly within the second face portion of the considered angle joint element, and in which each of said first, second, third and fourth angle joint elements is provided with an envelope extending between the first face portion and the second face portion of the considered angle joint element, said envelope being open along the opening of the considered angle joint element, said envelope being adapted for receiving a portion of the dowel plate and for enabling movement of said portion of the dowel plate within said envelope.

17. A system for transferring loads at a crossover point of a joint between at least a first, a second, a third and a fourth cast-in-place slabs, said system comprising at least:

a first angle joint element located at a corner of the first cast-in-place slab, said first angle joint element comprising at least a first face portion and a second face portion connected the one to the other, and at least one anchor means adapted to extend within the first cast-in-place slab, a second angle joint element located at a corner of the second cast-in-place slab, said second angle joint element comprising at least a first face portion and a second face portion connected the one to the other, and at least one anchor means adapted to extend within the second cast-in-place slab, wherein the second face portion of the second angle joint element extends substantially in front of the first face portion of the first angle joint element, a third joint element located at a corner of the third cast-in-place slab, said third joint element comprising at least a first face portion and a second face portion connected the one to the other, and at least one anchor means adapted to extend within the third cast-in-place slab, wherein the second face portion of the third angle joint element extends substantially in front of the first face portion of the second angle joint element, a fourth joint element located at a corner of the fourth cast-in-place slab, said fourth joint element comprising at least a first face portion and a second face portion connected the one to the other, and at least one anchor means adapted to extend within the fourth cast-in-place slab, wherein the second face portion of the fourth angle joint element extends substantially in front of the first face portion of the third angle joint element, and at least one dowel plate acting as means for transferring load at least between the first, second, third and fourth cast-in-place slabs proximate the said first, second, third and fourth angle joint elements, wherein at least one rod extends between the first face portion of at least one of the first, second, third and fourth angle joint elements and the second face portion of another of the first, second, third and fourth angle joint elements, and wherein relative movement between at least three joint elements occurs during the hardening of the cast-in-place slabs, wherein the first, second, third and fourth joint elements are respectively a first, a second, a third and a fourth angle joint element, wherein the first, second, third and fourth angle joint elements and the dowel plate are adapted so that, after hardening of the cast-in-place slabs and the said relative movement between at least three angle joint elements, the dowel plate has at least a first portion extending within a first piece selected from the group consisting of the first cast-in-place slab after its hardening, a second portion extending within a second piece selected from the group consisting of the second cast-in-place slab after its hardening and a casing attached to the second cast-in-place slab after its hardening, a third portion extending within a third piece selected from the group consisting of the third cast-in-place slab after its hardening and a casing attached to the third cast-in-place slab after its hardening, and a fourth portion extending within a fourth piece selected from the group consisting of the fourth cast-in-place slab after its hardening and a casing attached to the fourth cast-in-place slab after its hardening, and wherein a first member selected from the group consisting of said first angle joint element and the casing attached to the first angle joint member, a second member selected from the group consisting of said second angle joint element and the casing attached to said second angle joint element, a third member selected from the group consisting of said third angle joint element and the casing attached to said third angle joint element, and a fourth member selected from the group consisting of said fourth angle joint element and the casing attached to said fourth angle joint element are each provided with means for limiting the relative movements of the dowel plate towards the first, second, third and fourth angle joint elements along three orthogonal directions.

18. The system of claim 17, in which the first face portion of one of said angle joint elements and the second face portion of another of said angle joint elements are maintained the one to the other, before pouring or casting the slabs, by at least at connecting system comprising a male element working with a female element, said connecting system being adapted so as to enable a relative sliding movement between the said male element and the female element at least after the slabs being cast.

19. The system of claim 17, in which the system is made of metal.

20. The system of claim 17, in which at least the first angle joint element, the second angle joint element, the third angle joint element and the fourth angle joint element comprise each a profile having an intermediate portion selected from the group consisting of a bent portion and a curved portion extending between the first face portion and the second face portion of the profile considered, wherein said intermediate portion connects together the first and second face portions of the profile considered, wherein said intermediate portion has a curvature with a radius of at least 3 mm, in which the first angle joint element, the second angle joint element, the third angle joint element and the fourth angle joint element are each provided with an opening extending in their intermediate portion, partly in their first face portion and partly in their second face portion, wherein the openings of the first, second, third and fourth angle joint elements extend substantially in a same plane, and in that the dowel plate acting as means for transferring load between the first, second, third and fourth cast-in-place slabs is a plate element extending through the said openings of the said first, second, third and fourth angle joint elements.

21. A floor concrete surface comprising a series of cast-in-place slabs with metal joints there between, wherein relative movement of the metal joints occurs after the casting of the slabs, and wherein a series of crossover points are defined between adjacent cast-in-place slabs, said crossover points being enlarged after casting the slabs, in which substantially all crossover points are provided with a system for transferring load, thereby preventing crack formation adjacent to the crossover points, and in which the system for transferring loads at a crossover point of a joint between at least a first, a second and a third cast-in-place slabs comprises:

at least one dowel plate and at least a first angle joint element attached to the first cast-in-place slab, a second angle joint element attached to the second cast-in-place slab, and a third joint element attached to the third cast-in-place slab, wherein at one relative movement between at least two of said joint elements occurs during the hardening of the cast-in-place slabs, wherein the said first, second and third joint elements and at least one dowel plate are adapted so that, after hardening of the cast-in-place slabs and the said relative movement between at least two of said joint elements, the dowel plate has at least a first portion extending within a first piece selected from the group consisting of the first cast-in-place slab after its hardening and a casing attached to the first cast-in place slab after its hardening, a second portion extending within a second piece selected from the group the second cast-in-place slab after its hardening and a casing attached to the second cast-in place slab after its hardening, and a third portion extending within a third piece selected from the group consisting of the third cast-in-place slab after its hardening and a casing attached to the third cast-in place slab after its hardening, and wherein at least a first member selected from the group consisting of one of said joint elements and the casing attached to said one of said joint elements, and a second member selected from the group consisting of another of said joint elements and the casing attached to said another of said joint elements are each provided with means for limiting the relative movements of the dowel plate towards the said at least two joint elements along three orthogonal directions, wherein at least the first angle joint element and the second angle joint element each comprise a profile having an intermediate portion selected from the group consisting of a bent portion and a curved portion extending between the first face portion and the second face portion of the profile considered, wherein at least the first angle joint element and the second angle joint element are each provided with an opening extending in their intermediate portion, partly in their first face portion and partly in their second face portion, while the third joint element is provided with an opening, wherein the openings of the first and second angle joint elements, as well as the opening of the third joint element extend substantially in the same plane, and wherein the dowel plate is a plate element extending through the said openings of the first and second angle joint elements and the said opening of the third angle joint element.

22. The floor concrete surface of claim 21, in which the system for transferring loads at a crossover point of a joint between at least a first, a second and a third cast-in-place slabs comprises at least:

a first angle joint element located at a corner of the first cast-in-place slab, said first angle joint element comprising at least a first face portion and a second face portion connected the one to the other, and at least one anchor means adapted to extend within the first cast-in-place slab, a second angle joint element located at a corner of the second cast-in-place slab, said second angle joint element comprising at least a first face portion and a second face portion connected the one to the other, and at least one anchor means adapted to extend within the second cast-in-place slab, wherein the second face portion of the second angle joint element extends substantially in front of the first face portion of the first angle joint element, a third joint element located along a part selected from the group consisting of an edge of the third cast-in-place slab and a corner of the third cast-in-place slab, said third joint element comprising at least a face portion and at least one anchor means adapted to extend within the third cast-in-place slab, wherein said face portion of the third joint element extends in front of at least one face portion selected from the group consisting of one of the first and second face portions of the first angle joint element and one of the first and second face portions of the second angle joint element, and at least one dowel plate acting as means for transferring load at least between the first, second and third cast-in-place slabs proximate the first and second angle joint elements.

23. The floor concrete surface of claim 22, in which at least one of the angle joint elements is provided with an envelope extending between the first face portion and the second face portion of the considered angle joint element, said envelope being open along the openings of the first and second face portions, as well as of along the intermediate portion, said envelope being adapted for receiving a portion of the dowel plate and for enabling movement of said portion of the dowel plate within said envelope.

24. The floor concrete surface of claim 22, in which the system for transferring loads at a crossover point of a joint between at least a first, a second and a third cast-in-place slabs comprises at least the first angle joint element and the second angle joint element comprising each a profile having an intermediate portion selected from the group consisting of a bent portion and a curved portion extending between the first face portion and the second face portion of the profile considered, wherein said intermediate portion connects together the first and second face portions of the profile considered, wherein said intermediate portion has a curvature with a radius of at least 3 mm, in which the first angle joint element and the second angle joint element are each provided with an opening extending in their intermediate portion, partly in their first face portion and partly in their second face portion, while the third joint element is provided with an opening, wherein the openings of the first and second angle joint elements and the opening of the third joint element extend substantially in a same plane, and in that the dowel plate acting as means for transferring load between the cast-in-place slabs is a plate element extending through the said openings of the first and second angle joint elements, and of the third joint element.

25. The floor concrete surface of claim 21, in which at least the first angle joint element and the second angle joint element comprise each a profile having an intermediate portion selected from the group consisting of a bent portion and a curved portion extending between the first face portion and the second face portion of the profile considered, wherein said intermediate portion connects together the first and second face portions of the profile considered, wherein said intermediate portion has a curvature with a radius comprised between 4 mm and 40 mm, in which the first angle joint element and the second angle joint element are each provided with an opening extending in their intermediate portion, partly in their first face portion and partly in their second face portion, while the third joint element is provided with an opening, wherein the openings of the first and second angle joint elements and the opening of the third joint element extend substantially in a same plane, and in that the dowel plate acting as means for transferring load between the cast-in-place slabs is a plate element extending through the said openings of the first and second angle joint elements, and of the third joint element.

26. The floor concrete surface of claim 21, in which the system for transferring loads at a crossover point of a joint between at least a first, a second and a third cast-in-place slabs comprises at least:

a first angle joint element located at a corner of the first cast-in-place slab, said first angle joint element comprising at least a first face portion and a second face portion connected the one to the other, and at least one anchor means adapted to extend within the first cast-in-place slab, a second angle joint element located at a corner of the second cast-in-place slab, said second angle joint element comprising at least a first face portion and a second face portion connected the one to the other, and at least one anchor means adapted to extend within the second cast-in-place slab, wherein the second face portion of the second angle joint element extends substantially in front of the first face portion of the first angle joint element, a third joint element located along a part selected from the group consisting of an edge of the third cast-in-place slab and a corner of the third cast-in-place slab, said third joint element comprising at least a face portion and at least one anchor means adapted to extend within the third cast-in-place slab, wherein said face portion of the third joint element extends in front of at least one face portion selected from the group consisting of one of the first and second face portions of the first angle joint element and one of the first and second face portions of the second angle joint element, and at least one dowel plate acting as means for transferring load at least between the first, second and third cast-in-place slabs proximate the first and second angle joint elements, wherein at least one rod extends between the first face portion of at least one of the first, second and third joint elements and the second face portion of another of the first, second and third joint elements.

27. The floor concrete surface of claim 21, in which the dowel plate has a planar shape selected from the group consisting of a square shape, a rectangular shape, a circular shape, an oval shape, portions thereof and combinations thereof.

28. The floor concrete surface of claim 21, in which at least the first, second and third cast-in-place slabs have each lateral edges each provided with an edge joint profile, wherein the first, second and third joint elements are each provided with means for connecting the considered joint element to at least one edge joint profile.

29. The floor concrete surface of claim 21, in which the system for transferring loads at a crossover point of a joint between at least a first, a second and a third cast-in-place slabs comprises at least:

a first angle joint element located at a corner of the first cast-in-place slab, said first angle joint element comprising at least a first face portion and a second face portion connected the one to the other, and at least one anchor means adapted to extend within the first cast-in-place slab, a second angle joint element located at a corner of the second cast-in-place slab, said second angle joint element comprising at least a first face portion and a second face portion connected the one to the other, and at least one anchor means adapted to extend within the second cast-in-place slab, wherein the second face portion of the second angle joint element extends substantially in front of the first face portion of the first angle joint element, a third joint element located along a part selected from the group consisting of an edge of the third cast-in-place slab and a corner of the third cast-in-place slab, said third joint element comprising at least a face portion and at least one anchor means adapted to extend within the third cast-in-place slab, wherein said face portion of the third joint element extends in front of at least one face portion selected from the group consisting of one of the first and second face portions of the first angle joint element and one of the first and second face portions of the second angle joint element, and at least one dowel plate acting as means for transferring load at least between the first, second and third cast-in-place slabs proximate the first and second angle joint elements, in which the first face portion of the first angle joint element and the second face portion of the second angle joint element are maintained the one to the other, before pouring or casting the slabs, by at least a connecting system comprising a male element working with a female element, said connecting system being adapted so as to enable a relative sliding movement between the said male element and the female element at least after the slabs being cast.

30. The floor concrete surface of claim 21, in which each of said first and second angle joint elements of the system for transferring load comprise a first face portion and a second face portion connected the one to the other, in which each of said first and second angle joint elements is provided with an opening extending partly within the first face portion and partly within the second face portion of the considered angle joint element, and in which each of said first and second angle joint elements is provided with an envelope extending between the first face portion and the second face portion of the considered angle joint element, said envelope being open along the opening of the considered angle joint element, said envelope being adapted for receiving a portion of the dowel plate and for enabling movement of said portion of the dowel plate within said envelope.

31. The floor concrete surface of claim 21, in which a filler or a sealing product is injected at least partly in the crossover points.

32. A floor concrete surface comprising a series of cast-in-place slabs with metal joints there between, wherein relative movement of the metal joints occurs after the casting of the slabs, and wherein a series of crossover points are defined between adjacent cast-in-place slabs, said crossover points being enlarged after casting of the slabs, in which substantially all crossover points are provided with a system for transferring load, thereby preventing crack formation adjacent to the crossover points, and in which the system for transferring loads at a crossover point of a joint between at least a first, a second, a third and a fourth cast-in-place slabs comprises:

at least one dowel plate and at least a first angle joint element attached to the first cast-in-place slab, a second angle joint element attached to the second cast-in-place slab, and a third angle joint element attached to the third cast-in-place slab, a fourth angle joint element attached to the fourth cast-in-place slab, wherein a relative movement between at least three angle joint elements occurs during the hardening of the cast-in-place slabs, wherein the first, second, third and fourth angle joint elements are each provided with an opening, wherein the first, second, third and fourth angle joint elements and the dowel plate are adapted so that, after hardening of the cast-in-place slabs and the said relative movement between angle joint elements, the dowel plate has at least a first portion extending through the opening of the first angle joint element within a first piece selected from the group consisting of the first cast-in-place slab after its hardening and a casing attached to the first cast-in place slab after its hardening, a second portion extending through the opening of the second angle joint element within a second piece selected from the group consisting of the second cast-in-place slab after its hardening and a casing attached to the second cast-in place slab after its hardening, a third portion extending through the opening of the third angle joint element within a third piece selected from the group consisting of the third cast-in-place slab after its hardening and a casing attached to the third cast-in place slab after its hardening, and a fourth portion extending through an opening of the fourth angle joint element within a fourth piece selected from the group consisting of the fourth cast-in-place slab after its hardening and a casing attached to the fourth cast-in place slab after its hardening, and wherein a first member selected from the group consisting from the group consisting of said first angle joint element and the casing attached to said first angle joint element, a second member selected from the group consisting from the group consisting of said second angle joint element and the casing attached to said second angle joint element, a third member selected from the group consisting from the group consisting of said third angle joint element and the casing attached to said third angle joint element, and a fourth member selected from the group consisting from the group consisting of said fourth angle joint element and the casing attached to said fourth angle joint element are each provided with means for limiting the relative movements of the dowel plate towards the said first, second, third and fourth angle joint elements along three orthogonal directions.

33. The floor concrete surface of claim 32, in which the system for transferring loads at a crossover point of a joint between at least a first, a second, a third and a fourth cast-in-place slabs comprises at least:

a first angle joint element located at a corner of the first cast-in-place slab, said first angle joint element comprising at least a first face portion and a second face portion connected the one to the other, and at least one anchor means adapted to extend within the first cast-in-place slab, a second angle joint element located at a corner of the second cast-in-place slab, said second angle joint element comprising at least a first face portion and a second face portion connected the one to the other, and at least one anchor means adapted to extend within the second cast-in place slab, wherein the second face portion of the second angle joint element extends substantially in front of the first face portion of the first angle joint element, a third joint element located at a corner of the third cast-in-place slab, said third joint element comprising at least a first face portion and a second face portion connected the one to the other, and at least one anchor means adapted to extend within the third cast-in-place slab, wherein the second face portion of the third angle joint element extends substantially in front of the first face portion of the second angle joint element, a fourth joint element located at a corner of the fourth cast-in-place slab, said fourth joint element comprising at least a first face portion and a second face portion connected the one to the other, and at least one anchor means adapted to extend within the fourth cast-in-place slab, wherein the second face portion of the fourth angle joint element extends substantially in front of the first face portion of the third angle joint element, and at least one dowel plate acting as means for transferring load at least between the first, second, third and fourth cast-in-place slabs proximate the said first, second, third and fourth angle joint elements.

34. The floor concrete surface of claim 33, in which the first angle joint element, the second angle joint element, the third angle joint element and the fourth angle joint element comprise each a profile having an intermediate portion selected from the group consisting of a bent portion and a curved portion extending between the first face portion and the second face portion of the profile considered, wherein said intermediate portion connects together the first and second face portions of the profile considered, wherein said intermediate portion has a curvature with a radius of at least 3 mm, in which the first angle joint element, the second angle joint element, the third angle joint element and the fourth angle joint element are each provided with an opening extending in their intermediate portion, partly in their first face portion and partly in their second face portion, wherein the openings of the first, second, third and fourth angle joint elements extend substantially in a same plane, and in which the dowel plate acting as means for transferring load between the first, second, third and fourth cast-in-place slabs is a plate element extending through the said openings of the said first, second, third and fourth angle joint elements.

35. The floor concrete surface of claim 32, in which the system for transferring loads at a crossover point of a joint between at least a first, a second, a third and a fourth cast-in-place slabs comprises at least:

a first angle joint element located at a corner of the first cast-in-place slab, said first angle joint element comprising at least a first face portion and a second face portion connected the one to the other, and at least one anchor means adapted to extend within the first cast-in-place slab, a second angle joint element located at a corner of the second cast-in-place slab, said second angle joint element comprising at least a first face portion and a second face portion connected the one to the other, and at least one anchor means adapted to extend within the second cast-in-place slab, wherein the second face portion of the second angle joint element extends substantially in front of the first face portion of the first angle joint element, a third joint element located at a corner of the third cast-in-place slab, said third joint element comprising at least a first face portion and a second face portion connected the one to the other, and at least one anchor means adapted to extend within the third cast-in-place slab, wherein the second face portion of the third angle joint element extends substantially in front of the first face portion of the second angle joint element, a fourth joint element located at a corner of the fourth cast-in-place slab, said fourth joint element comprising at least a first face portion and a second face portion connected the one to the other, and at least one anchor means adapted to extend within the fourth cast-in-place slab, wherein the second face portion of the fourth angle joint element extends substantially in front of the first face portion of the third angle joint element, and at least one dowel plate acting as means for transferring load at least between the first, second, third and fourth cast-in-place slabs proximate the said first, second, third and fourth angle joint elements, wherein at least the first angle joint element, the second angle joint element, the third angle joint element and the fourth angle joint element comprise each a profile having an intermediate portion selected from the group consisting of a bent portion and a curved portion extending between the first face portion and the second face portion of the profile considered, wherein said intermediate portion connects together the first and second face portions of the profile considered, wherein said intermediate portion has a curvature with a radius comprised between 4 mm and 40 mm, wherein the first angle joint element, the second angle joint element, the third angle joint element and the fourth angle joint element are each provided with an opening extending in their intermediate portion, partly in their first face portion and partly in their second face portion, wherein the openings of the first, second, third and fourth angle joint elements extend substantially in a same plane, and wherein the dowel plate acting as means for transferring load between the first, second, third and fourth cast-in-place slabs is a plate element extending through the said openings of the said first, second, third and fourth angle joint elements.

36. The floor concrete surface of claim 35, in which each of said first, second, third and fourth angle joint elements is provided with an envelope extending between the first face portion and the second face portion of the considered angle joint element, said envelope being open along the openings of the first and second face portions, as well as of along the intermediate portion, said envelope being adapted for receiving a portion of the dowel plate and for enabling movement of said portion of the dowel plate within said envelope.

37. The floor concrete surface of claim 32, in which each of said first, second, third and fourth angle joint elements of the system for transferring load comprises a first face portion and a second face portion connected the one to the other, in which each of said first, second, third and fourth angle joint elements is provided with an opening extending partly within the first face portion and partly within the second face portion of the considered angle joint element, and in which each of said first, second, third and fourth angle joint elements is provided with an envelope extending between the first face portion and the second face portion of the considered angle joint element, said envelope being open along the opening of the considered angle joint element, said envelope being adapted for receiving a portion of the dowel plate and for enabling movement of said portion of the dowel plate within said envelope.

38. The floor concrete surface of claim 32, in which a filler or a sealing product is injected at least partly in the crossover points.

39. A floor concrete surface of comprising a series of cast-in-place slabs with metal joints there between, wherein relative movement of the metal joints occurs after the casting of the slabs, and wherein a series of crossover points are defined between adjacent cast-in-place slabs, said crossover points being enlarged after casting of the slabs, in which substantially all crossover points are provided with a system for transferring load, thereby preventing crack formation adjacent to the crossover points, and in which the system for transferring loads at a crossover point of a joint between at least a first, a second, a third and a fourth cast-in-place slabs comprises at least:

a first angle joint element located at a corner of the first cast-in-place slab, said first angle joint element comprising at least a first face portion and a second face portion connected the one to the other, and at least one anchor means adapted to extend within the first cast-in-place slab, a second angle joint element located at a corner of the second cast-in-place slab, said second angle joint element comprising at least a first face portion and a second face portion connected the one to the other, and at least one anchor means adapted to extend within the second cast-in-place slab, wherein the second face portion of the second angle joint element extends substantially in front of the first face portion of the first angle joint element, a third joint element located at a corner of the third cast-in-place slab, said third joint element comprising at least a first face portion and a second face portion connected the one to the other, and at least one anchor means adapted to extend within the third cast-in-place slab, wherein the second face portion of the third angle joint element extends substantially in front of the first face portion of the second angle joint element, a fourth joint element located at a corner of the fourth cast-in-place slab, said fourth joint element comprising at least a first face portion and a second face portion connected the one to the other, and at least one anchor means adapted to extend within the fourth cast-in-place slab, wherein the second face portion of the fourth angle joint element extends substantially in front of the first face portion of the third angle joint element, and at least one dowel plate acting as means for transferring load at least between the first, second, third and fourth cast-in-place slabs proximate the said first, second, third and fourth angle joint elements, wherein at least one rod extends between the first face portion of at least one of the first, second, third and fourth angle joint elements and the second face portion of another of the first, second, third and fourth angle joint elements, wherein relative movement between at least three joint elements occurs during the hardening of the cast-in-place slabs, wherein the first, second, third and fourth joint elements are respectively a first, a second, a third and a fourth angle joint element, wherein the first, second, third and fourth angle joint elements and the dowel plate are adapted so that, after hardening of the cast-in-place slabs and the said relative movement between at least three angle joint elements, the dowel plate has at least a first portion extending within a first piece selected from the group consisting of the first cast-in-place slab after its hardening, a second portion extending within a second piece selected from the group consisting of the second cast-in-place slab after its hardening and a casing attached to the second cast-in-place slab after its hardening, a third portion extending within a third piece selected from the group consisting of the third cast-in-place slab after its hardening and a casing attached to the third cast-in-place slab after its hardening, and a fourth portion extending within a fourth piece selected from the group consisting of the fourth cast-in- place slab after its hardening and a casing attached to the fourth cast-in-place slab after its hardening, and wherein a first member selected from the group consisting of said first angle joint element and the casing attached to the first angle joint member, a second member selected from the group consisting of said second angle joint element and the casing attached to said second angle joint element, a third member consisting of said third angle joint element and the casing attached to said third angle joint element, and a fourth member selected from the group consisting of said fourth angle joint element and the casing attached to said fourth angle joint element are each provided with means for limiting the relative movements of the dowel plate towards the first, second, third and fourth angle joint elements along three orthogonal directions.

40. The floor concrete surface of claim 39, in which the system for transferring loads at a crossover point of a joint between at least a first, a second, a third and a fourth cast-in-place slabs comprises at least:

a first angle joint element located at a corner of the first cast-in-place slab, said first angle joint element comprising at least a first face portion and a second face portion connected the one to the other, and at least one anchor means adapted to extend within the first cast-in-place slab, a second angle joint element located at a corner of the second cast-in-place slab, said second angle joint element comprising at least a first face portion and a second face portion connected the one to the other, and at least one anchor means adapted to extend within the second cast-in-place slab, wherein the second face portion of the second angle joint element extends substantially in front of the first face portion of the first angle joint element, a third joint element located at a corner of the third cast-in-place slab, said third joint element comprising at least a first face portion and a second face portion connected the one to the other, and at least one anchor means adapted to extend within the third cast-in-place slab, wherein the second face portion of the third angle joint element extends substantially in front of the first face portion of the second angle joint element, a fourth joint element located at a corner of the fourth cast-in-place slab, said fourth joint element comprising at least a first face portion and a second face portion connected the one to the other, and at least one anchor means adapted to extend within the fourth cast-in-place slab, wherein the second face portion of the fourth angle joint element extends substantially in front of the first face portion of the third angle joint element, and at least one dowel plate acting as a means for transferring load at least between the first, second, third and fourth cast-in-place slabs proximate the said first, second, third and fourth angle joint elements, in which the first face portion of one of said angle joint elements and the second face portion of another of said angle joint elements are maintained the one to the other, before pouring or casting the slabs, by at least at connecting system comprising a male element working with a female element, said connecting system being adapted so as to enable a relative sliding movement between the said male element and the female element at least after the slabs being cast.

41. The floor concrete surface of claim 39, in which a filler or a sealing product is injected at least partly in the crossover points.

42. The use of a floor concrete surface according to claim 39 for an area selected from the group consisting of a stockage area, a commercial area and an industrial area.

43. The floor concrete surface of claim 39, in which at least the first angle joint element, the second angle joint element, the third angle joint element and the fourth angle joint element of the system for transferring load at crossover points comprise each a profile having an intermediate portion selected from the group consisting of a bent portion and a curved portion extending between the first face portion and the second face portion of the profile considered, wherein said intermediate portion connects together the first and second face portions of the profile considered, wherein said intermediate portion has a curvature with a radius of at least 3 mm, in which the first angle joint element, the second angle joint element, the third angle joint element and the fourth angle joint element are each provided with an opening extending in their intermediate portion, partly in their first face portion and partly in their second face portion, wherein the openings of the first, second, third and fourth angle joint elements extend substantially in a same plane, and in that the dowel plate acting as means for transferring load between the first, second, third and fourth cast-in-place slabs is a plate element extending through the said openings of the said first, second, third and fourth angle joint elements.

* * * * *